US010077137B1

(12) United States Patent
Wang et al.

(10) Patent No.: US 10,077,137 B1
(45) Date of Patent: Sep. 18, 2018

(54) COMBINATION CARRYING DEVICE

(71) Applicant: Amazon Technologies, Inc., Seattle, WA (US)

(72) Inventors: Xiao Wang, Seattle, WA (US); Thomas Duester, Munich (DE); Ashley Anne Arhart, Seattle, WA (US); Rodger Benson, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/980,504

(22) Filed: Dec. 28, 2015

(51) Int. Cl.

| | |
|---|---|
| ***H01F 1/04*** | (2006.01) |
| ***B65D 25/16*** | (2006.01) |
| ***B65D 1/38*** | (2006.01) |
| ***B65D 25/32*** | (2006.01) |

(52) U.S. Cl.
CPC ..... *B65D 25/16* (2013.01); *B65D 1/38* (2013.01); *B65D 25/32* (2013.01); *H01F 1/04* (2013.01)

(58) Field of Classification Search
CPC ..... H01F 1/04; B65D 25/32; B65D 21/04; B65D 21/0233
USPC ..... 220/495.06–495.11
See application file for complete search history.

(56) References Cited

U.S. PATENT DOCUMENTS

| | | | | |
|---|---|---|---|---|
| 3,032,230 | A | 5/1962 | Gerber | |
| 3,423,004 | A | 1/1969 | Christensson | |
| D259,819 | S | 7/1981 | Cornou | |
| 4,642,934 | A * | 2/1987 | Carlson | A01K 63/02 220/495.03 |
| 5,337,910 | A | 8/1994 | Picozza et al. | |
| 5,469,986 | A * | 11/1995 | Jang | B65D 1/38 220/760 |
| 5,938,035 | A | 8/1999 | Oglesby et al. | |
| 7,163,120 | B1 | 1/2007 | Blucher | |
| 7,318,247 | B2 | 1/2008 | Libman et al. | |
| 7,320,411 | B1 * | 1/2008 | Shenosky | A45C 3/04 220/495.06 |
| 7,669,713 | B2 | 3/2010 | Stahl | |
| 9,473,747 | B2 | 10/2016 | Kobres et al. | |
| 2003/0017930 | A1 | 1/2003 | Aizawa | |
| 2004/0016784 | A1 | 1/2004 | Berry | |
| 2007/0160783 | A1 | 7/2007 | Rieser et al. | |
| 2008/0128429 | A1 * | 6/2008 | Towery | A47G 19/2227 220/574 |
| 2013/0277265 | A1 | 10/2013 | Varbanov | |

* cited by examiner

*Primary Examiner* — Stephen Castellano
(74) *Attorney, Agent, or Firm* — Athorus, PLLC

(57) ABSTRACT

A combination carrying device includes a rigid basket having a flexible bag nested therein. The flexible bag may be formed from one or more fabrics or like materials and form or define a tapered volume having a pair of handle extensions. The rigid basket may be formed from plastics or like materials and include rotatable handles mounted to sides of the rigid basket. The flexible bag and the rigid basket include magnetically compatible components that cause the flexible bag to remain nested within the rigid basket when such components are within a close proximity of one another. A customer carrying a combination carrying device in a materials handling facility may place one or more items in the flexible bag nested within the rigid basket, and extract the flexible bag from the rigid basket after executing a purchase for the items therein.

20 Claims, 15 Drawing Sheets

COMBINATION CARRYING DEVICE

BACKGROUND

Materials handling facilities such as warehouses or retail stores often provide durable item carriers to users, who may utilize the item carriers when transporting items throughout the facilities. For example, such facilities commonly provide users with carts, e.g., large vessels formed from metal or plastic that are configured to travel on wheels, as well as baskets or totes having substantially smaller vessels that may be carried by users with one or more handles.

If a user identifies one or more items that he or she intends to retrieve from a shelf or other location within a materials handling facility, the user may remove the items, place the items into an item carrier, and transport the items in the item carrier to an intended destination such as a distribution station or cash register, where the user may transfer the items from the item carrier to another facility at the destination or otherwise transition the items to another human operator or automated agent. When the user transfers the items at the intended destination, or transitions the items to the human operator or the automated agent, the user or the human operator must manually remove the items from the item carrier, and then relinquish control over the item carrier back to the materials handling facility. If such items feature an awkward or unmanageable shape, or lack a handle, the items may be removed from the item carrier and placed inside a plastic or fabric bag, or like container, to aid in the transfer or transition thereof.

Although durable item carriers such as baskets, totes or carts are effective and useful in enabling users to transport items throughout a materials handling facility, the processes by which users may purchase or otherwise check out such items are presently plagued by physical limitations and delays, in that the items must be removed from the item carrier before being placed in a bag or like container that may be released to the user. Such actions, whether performed by a staff member or a user, necessarily slow the rate at which the user may complete a transaction for the items, or otherwise take control of such items. Moreover, many bags in which such items may be placed are flimsy and formed from materials having relatively low shear strengths or yield stresses, such as paper or plastic.

DETAILED DESCRIPTION

Figure 1B:
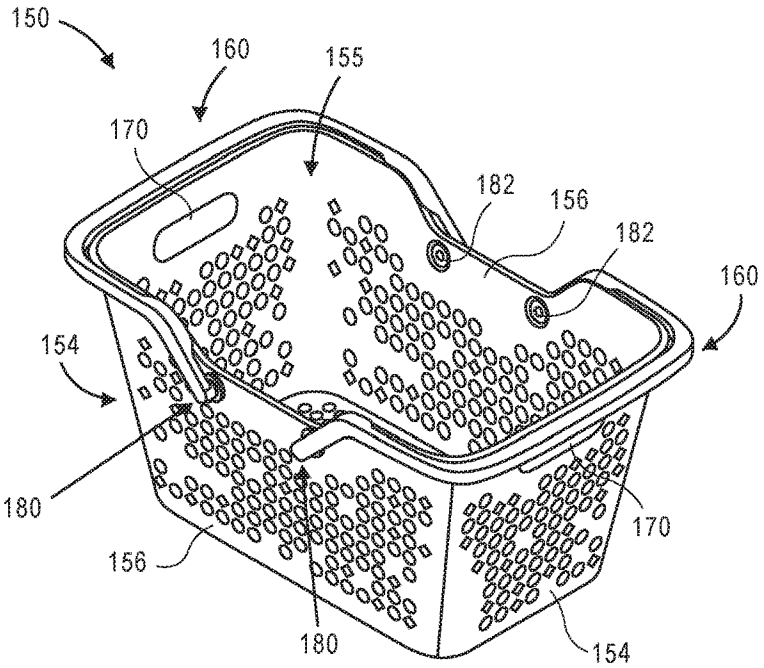
FIGS. 1A through 1H are views of aspects of one combination carrying device in accordance with implementations of the present disclosure.

As is set forth in greater detail below, the present disclosure is directed to combination carrying devices that may be utilized by users in materials handling facilities or like environments. More specifically, the systems and methods disclosed herein include totes or other carrying devices including baskets having rigid structural frames with magnetically compatible components (e.g., magnetized elements and metallic elements) provided along interior surfaces of such frames, and on outer surfaces of bags that are nested within such frames, with shapes and volumes that correspond to shapes and volumes of the frames. The carrying devices may be configured such that the bags are folded and magnetically held into place or nested within the baskets, when the magnetically compatible components of the bags and the baskets are aligned and in close proximity with one another. The bags may include side panels and end panels, with the side panels having longer dimensions and/or larger areas than the end panels, as well as folded handles that are disposed within an inner rim of the upper perimeter. The baskets may feature retractable handles that are rotatably mounted to outer surfaces of such frames, thereby enabling the handles to align with such frames when retracted, and permitting two or more of the carrying devices to be stacked with bags nested within respective baskets.

In accordance with the present disclosure, users may use the combination carrying devices to transport items within a materials handling facility and, upon completing a picking of items from inventory locations within the materials handling facility, lift the bag by the handles. When the lifting force provided by the user overcomes the magnetic force coupling the magnetically compatible components of the bags to those of the baskets, the user may remove the bag and the items therein from the basket, and carry the bag to an intended destination with the items therein. For example, if the user has retrieved items from one or more inventory locations, and the items are to be transitioned to a packing station or conveyor, the user may lift the bag by the handles to decouple metallic elements disposed on the bag from magnetized elements disposed within the basket in corresponding locations, and remove both the bag and the items from the basket collectively. The bag and the items therein may be transitioned to a packing station or onto a conveyor as a single unit, rather than individually, which would require removing each item from the basket and transitioning the items to the packing station or onto the conveyor one by one.

As used herein, a "materials handling facility" may include, but is not limited to, warehouses, distribution centers, cross-docking facilities, order fulfillment facilities, packaging facilities, shipping facilities, rental facilities, libraries, retail stores or establishments, wholesale stores, museums, or other facilities or combinations of facilities for performing one or more functions of material or inventory handling for any purpose.

Figure 1A:
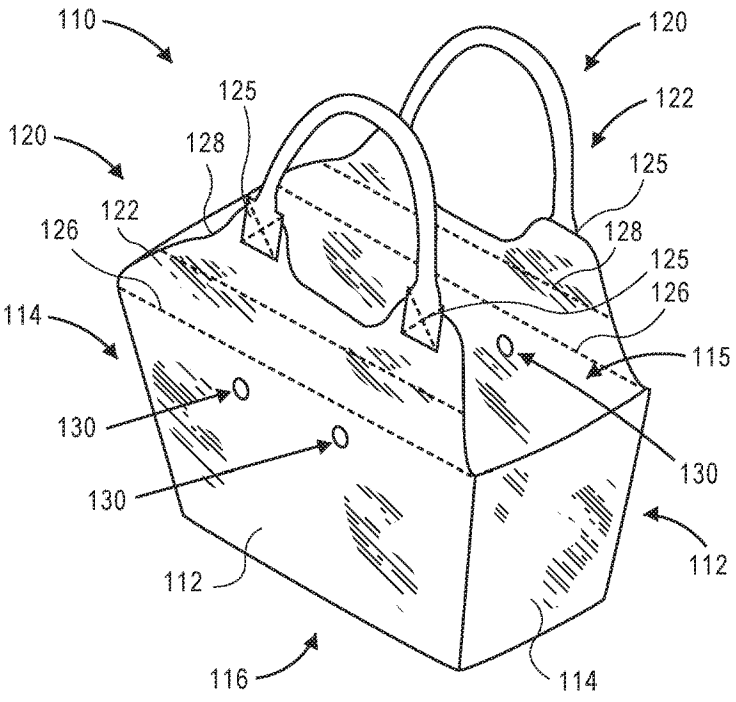

Referring to FIG. 1A through 1H, a combination carrying device 100 including a bag 110 and a basket 150 is shown. The bag 110 includes a pair of long sides (or side panels) 112, a pair of short sides (or end panels) 114 and a bottom 116. The long sides 112 and the short sides 114 have substantially trapezoidal shapes, and the bottom 116 has a substantially rectangular shape. As is shown in FIGS. 1A and 1B, the long sides 112 have upper edges and lower edges having lengths that are comparatively greater than lengths of corresponding upper edges and lower edges of the short sides 114, and areas that are comparatively larger than areas of the short sides 114.

The long sides 112, the short sides 114 and the bottom 116 form or define a tapered or frustopyramidal hollow volume 115, e.g., a hollow cavity having a shape corresponding to a frustrum of a pyramid, or a pyramidal frustrum, for receiving one or more items therein. The volume 115 has a substantially rectangular horizontal cross-section with areas of descending size, from top to bottom, beginning with an area formed or defined by upper edges of the long sides 112 and the short sides 114, and concluding with an area of the bottom 116.

As is shown in FIG. 1A, each of the long sides 112 includes a pair of metallic elements 130 embedded or otherwise provided thereon. The metallic elements 130 may be any sufficiently sized, magnetically attractive hardware component such as a rivet, a washer, a nut and bolt combination, or any other extension for causing discrete regions within which the metallic elements 130 are provided to be subject to magnetic fields produced by one or more sources, and magnetically drawn or coupled to such sources accordingly. In some implementations, the metallic elements 130 may extend through the long sides 112 of the bag 110. In some other implementations, the metallic elements may be stitched or otherwise joined to an outer surface or an inner surface of the long sides 112, e.g., through one or more stitches or adhesives. Additionally, in some implementations, such as the bag 110 of FIG. 1A, the metallic elements 130 may exposed, e.g., not covered by any portion of the bag 110. In some other implementations (not shown), the metallic elements 130 may be surrounded or embedded within two or more layers of the long sides 112, e.g., a pocket or pouch formed or defined by such layers. Where one or more of the metallic elements 130 is surrounded or embedded within the long sides 112, the corresponding thicknesses of such long sides 112 may be preferably selected to ensure that the metallic elements 130 remain subject to influences of sufficiently strong magnetic fields, and without diminishing or attenuating such fields to any appreciable extent.

Additionally, the bag 110 further includes a pair of handle sections 120. Each of the pair of handle sections 120 comprises a panel (or extension) 122 joined to one of the long sides 112. Each of the pair of handle sections 120 also includes a strap handle 124 joined thereto by a pair of stitched mounts 125, with each of the stitched mounts 125 provided at one end of one of the strap handles 124. For example, in the implementation of the bag 110 shown in FIG. 1A, the strap handles 124 may include substantially flat portions of durable material (e.g., canvas, vinyl, leather or nylon) at which the stitched mounts 125 may be joined to the panels 122. The substantially flat portions may transition to substantially rounded portions between the respective stitched mounts 124, and may be gripped by one or more users. In some implementations, the substantially rounded portions of the strap handles 124 may be fortified by a flexible tube (e.g., rubber or plastic) or other form of reinforcement. Additionally, those of ordinary skill in the pertinent arts will recognize that the strap handles 124 may take any shape or form, and may be joined to the bag 110 in general, or to the long sides 112 in particular, in any manner. For example, the strap handle 124 may include ends that are joined to the long sides 112 using one or more swivel snaps, loops or sliders, buckles, zippers, O-rings, D-rings or rivets, or any other type or form of fastener, in accordance with the present disclosure, and need not be joined to the long sides 112 by stitching.

As is shown in FIG. 1A, a scored line 126 is provided between each of the long sides 112 and one of the panels 122, to accommodate one or more creases between the long sides 112 and the panels 122 when the bag 110 is folded for insertion into the basket 150. Each of the panels 122 further includes a scored line 128 therein to accommodate one or more creases within the panel 122 when the bag 110 is folded for insertion into the basket 150. Those of ordinary skill in the pertinent arts will recognize that the bag 110 may include a single scored line, or three or more scored lines, or need not include any scored lines in order to accommodate folds or creases. Furthermore, as is discussed above, the materials and thicknesses of the panels 122 may be preferably selected to ensure that the metallic elements 130 remain subject to influences of sufficiently strong magnetic fields, even where the panels 122 are folded or creased into two or more layers, and without diminishing or attenuating magnetic forces applied to the metallic elements 130 to any appreciable extent.

As is shown in FIG. 1B, the basket 150, like the bag 110, includes a pair of long sides (or end panels) 152, a pair of short sides (or side panels) 154 and a bottom 156 which also form or define a tapered or frustopyramidal hollow volume 155 corresponding to the tapered or frustopyramidal hollow volume 115 of the bag 110 for receiving the bag 110 and the contents thereof within. The basket 150 further includes a pair of pivotable handles 160 and a pair of slotted handles 170.

The long sides 152 and the short sides 154 of the basket 150 have substantially trapezoidal shapes, and the bottom 156 has a substantially rectangular shape. Additionally, and also like the volume 115 of the bag 110, the volume 155 has a substantially rectangular horizontal cross-section with areas of descending size, from top to bottom, beginning with an area formed or defined by upper edges of the long sides 152 and the short sides 154, and concluding with an area of the bottom 156. Alternatively, the volume 155 may have a corresponding frustoconical volume, e.g., a hollow cavity having a tapered shape corresponding to a frustrum of a cone, or a conic frustrum, or any other tapered volume having any cross-sectional shapes or areas and one or more continuous surfaces, such as ellipses, circles or other regular or irregular shapes. The volume 155 may be formed from sides or panels having substantially equal lengths, e.g., with square cross-sections, such that none of the sides is longer or shorter than another, or that none of the panels constitutes either a side or an end of the volume 155.

Moreover, as is shown in FIGS. 1B and 1D-1H, each of the long sides 152, the short sides 154 and the bottom 156 includes a plurality of holes, openings or perforations extending therethrough in a regular pattern or lattice, or irregularly. For example, where two or more of the combination carrying devices 100 are provided in a stack, e.g., with a basket 150 of a first combination carrying device 100 inserted into an opening 115 of a bag 110 nested within a second combination carrying device 100, the holes, openings or perforations may reduce the vacuum associated with the removal of combination carrying devices from a stack, and enable the bag 100 to remain nested therein as a combination carrying device is removed. Those of ordinary skill in the pertinent arts will recognize that a number, a size, a shape and/or an arrangement or pattern of such holes, openings or perforations may be selected on any functional or stylistic basis, including but not limited to strength or durability, intended use (e.g., sizes of objects to be carried within the bag 110 or the basket 150) or cost. For example, the holes, openings or perforations within the long sides 152, the short sides 154 or the bottom 156 may be formed in shapes of logos, letters, numbers or symbols, and may be either homogenous or heterogeneous in size or shape.

The long sides 152, the short sides 154 or the bottom 156 of the basket 150 may be formed from any suitable materials, such as plastics (e.g., thermoplastics or thermosetting plastics such as epoxy or phenolic resins, polyurethanes or polyesters, as well as polyethylenes, polypropylenes or polyvinyl chlorides, acrylonitrile butadiene styrenes, recycled plastics, bioplastics, cellulose or compostable plastics, natural plastics), wood (e.g., woods with sufficient strength properties such as ash), metals (e.g., lightweight metals such as aluminum, or steel, and formed from wire, mesh, sheets or other substantially planar sections having one or more openings provided therein), or materials formed from natural fibers.

As is shown in FIG. 1B, each of the handles 160 has an elongated shape that may substantially conforms to a portion of an upper perimeter of the basket 150, and is mounted or otherwise attached on opposite sides of the basket 150 (e.g., opposite long sides 152) at pivotable connections 180, e.g., about or near central portions of the long sides 152, extending outwardly and substantially horizontally with respect to the basket 150. The pivotable connections 180 extend outwardly from outer surfaces of the long sides 152, and include magnetized elements 182 disposed on inner surfaces of the long sides 152.

The handles 160 may include one or more grips or grip-like elements that may be grasped by a user when rotating or pivoting the handles 160 about axes defined by their respective pivotable connections 180, or when carrying the basket 150 by the handles 160. For example, such grips may include or comprise narrowed or rounded portions of the handles 160 that rest on or lie alongside or near the short sides 154 of the basket 150 when the handles 160 are pivoted downward, fully exposing the volume 155, and may be functionally joined together when the handles 160 are pivoted upward, above the volume 155. In some embodiments, the handles 160 may include grips having substantially smaller cross-sectional areas than the remainder of the handles 160, e.g., end portions of the handles 160 that are joined to the pivotable connections 180. The handles 160 may further include one or more flat surfaces that come into contact with one another when each of the handles 160 is pivoted upward above the volume 155, functionally joining the handles 160 together into a single, grippable cross-section that may be easily grasped by one or more hands of a user, or carried about one or more arms of the user. Additionally, each of the handles 160 may have a rounded external edge thereof, such that when the handles 160 are pivoted upward and above the volume 155, the handles 160 form a combined cross-section that is comfortable to a user of the basket 150 who is grasping the handles 160 with one or more hands or carrying the basket 150 by way of the handles 160 with one or more arms. Similarly, the slotted handles 170 are shown as being provided on the short sides 154, and may be fixed openings that are punched, carved, cut out or molded within the short sides 154 and may accommodate hands or other body parts of a worker in order to manipulate the basket 150 and any bag or contents (not shown) provided therein.

Each of the pivotable connections 180 may include one or more components extending through one or more bores or other substantially cylindrical openings provided on the long sides 152 and between an interior of the basket 150 and an exterior of the basket 150 for each of the handles 160, which may be mounted or attached at opposite ends thereof to one or more locations on the basket 150 by way of such bores. For example, in some implementations, the pivotable connections 180 may be mounted to outer faces of the long sides 152 via fasteners (e.g., one or more connectors such as threaded bolts or screws, rivets or like components) that extend through bores provided in the long sides 152 and also mount the magnetized element 182 to inner faces of the long sides 152 in corresponding locations.

Bores for mounting pivotable connections 180 and/or magnetized elements 182 to the basket 150 may be formed within or associated with the long sides 152 in any manner. For example, in some implementations, the bores may be formed integral to the long sides 152 of the basket 150 by injection molding, or by any means by which the baskets 150 are formed. Alternatively, the bores may be independent implements that are mechanically joined to the long sides 152 after the baskets 150 have been formed. In some implementations, the bores for mounting the pivotable connections 180 and the magnetized elements 182 may include one or more flanges or collars that are sized and shaped to correspond with and accommodate one or more fasteners extending therethrough, or to provide adequate spacing between the pivotable connections 180 and the long sides 152. Additionally, such bores may be provided with faces or angular extensions that permit the handles 160 to pivot or rotate about axes defined by the bores and the pivotable connection 180 within a predetermined plane. The long sides 152 and/or the pivotable connections 180 may include one or more mechanical stops that mechanically restrict the handles 160 from pivoting beyond a predetermined extent.

Furthermore, although the handles 160 of FIG. 1B are shown as being mounted to the long sides 152 of the basket 150, and the slotted handles 170 are shown as being provided on the short sides 154, those of ordinary skill in the pertinent arts will recognize that in some implementations, the handles 160 could be mounted to the short sides 154 of the basket 150, and pivot between a first position in which the handles 160 rest on or lie alongside or near the long sides 152 of the basket 150 when the handles 160 are pivoted downward, fully exposing the volume 155, a second position in which the handles 160 are pivoted upward and over the volume 155. Likewise, in some implementations, the slotted handles 170 could be punched, carved, cut out or molded within the long sides 152. Alternatively, in other implementations, both the handles 160 and the slotted handles 170 could be provided on the same sides (e.g., on the long sides 152 or the short sides 154) of the basket 150.

In accordance with implementations of the present disclosure, the handles 160 may, like the long sides 152, the short sides 154 or the bottom 156, be formed from any suitable materials, such as plastics (e.g., thermoplastics or thermosetting plastics such as epoxy or phenolic resins, polyurethanes or polyesters, as well as polyethylenes, polypropylenes or polyvinyl chlorides, acrylonitrile butadiene styrenes, as well as recycled plastics, bioplastics, cellulose or compostable plastics, natural plastics), wood (e.g., woods with sufficient strength properties such as ash), metals (e.g., lightweight metals such as aluminum), composites or other durable materials that may be gripped by a user and support the weight of the baskets 150 and any contents provided therein. Additionally, in accordance with other implementations of the present disclosure, the handles 160 may have any suitable length with respect to one or more dimensions of the baskets 150, in order to accommodate objects of varying sizes or shapes within the volume 155.

Figure 1D:
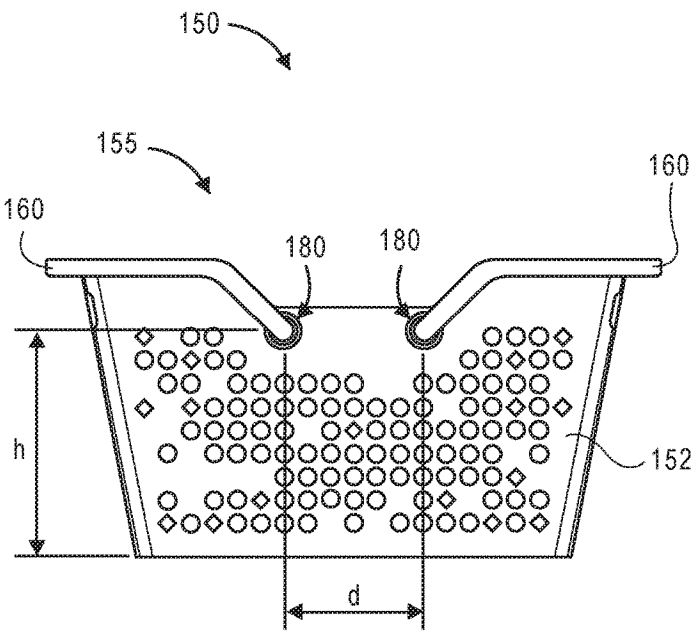

As is shown in FIG. 1A and FIG. 1B, the bag 110 and the basket 150 have corresponding tapered or frustopyramidal shapes. For example, the various internal and external angles of the bag 110, e.g., the angles formed by the joining of the planar sections of the long sides 112, the short sides 114, and the bottom 116 of the bag 110, are substantially equal to the angles formed by the joining of the planar sections of the long sides 152, the short sides 154 and the bottom 156 of the basket 150. Additionally, as is shown in FIGS. 1C and 1D, the locations of the metallic elements 130 on the bag 110 and the pivotable connections 180 and magnetized elements 182 on the basket 150 correspond to one another, such that the metallic elements 130 may be magnetically drawn or coupled to the magnetized elements 182 when the bag 110 is inserted into the basket 150, such as is shown in FIG. 1E.

Figure 1C:
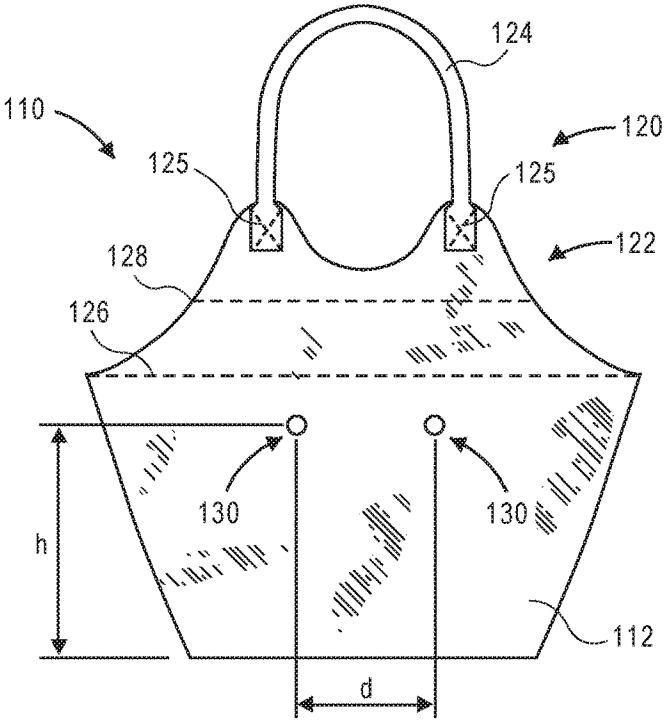
Figure 1E:
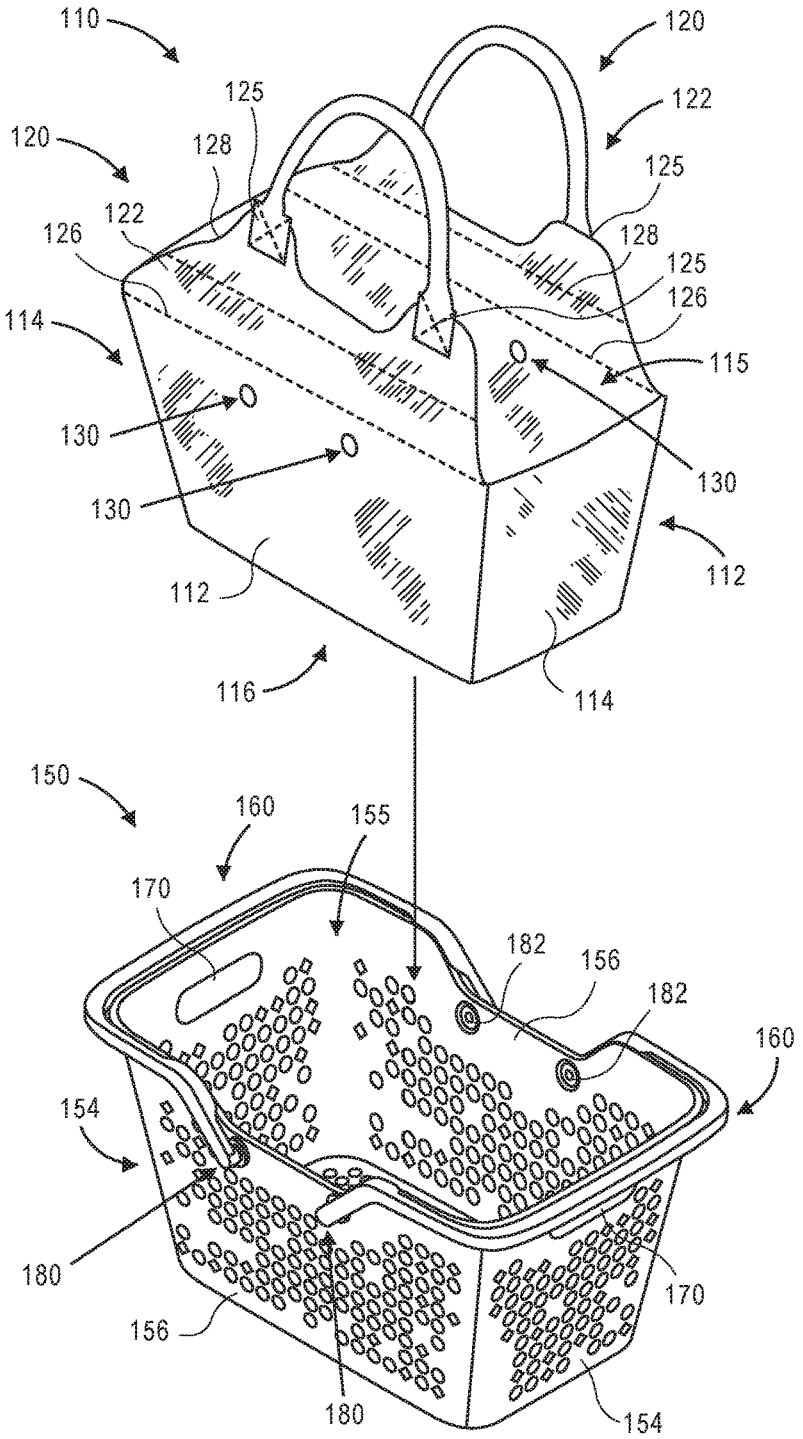

For example, as is shown in FIG. 1C, the metallic elements 130 are provided at a height h with respect to the bottom 116 on the long side 112 of the bag 110, and are separated by a distance d thereon. Likewise, as is shown in FIG. 1D, the pivotable connections 180 are mounted to an outer face of the long side 152 of the basket 150, and the magnetized elements 182 are mounted to an inner face of the long side 152 of the basket 150, at a height h with respect to the bottom 156, and are separated by a distance of d therein. Moreover, the metallic elements 130 and the magnetized elements 182 may have any size, shape, dimension or mass. In some implementations, the metallic elements 130 may have diameters corresponding to a diameter of the magnetized element 182. For example, the metallic element 130 may be a rivet or washer having a diameter of one-half of an inch (0.500"), and the magnetized element 182 may have a diameter of approximately three-quarters of an inch (0.750"), and may be approximately one-eighth of an inch (0.125") thick. The metallic elements 130 and the magnetized elements 182 may have any diameters, thicknesses or dimensions, and may be formed from any materials in accordance with the present disclosure.

Figure 1F:
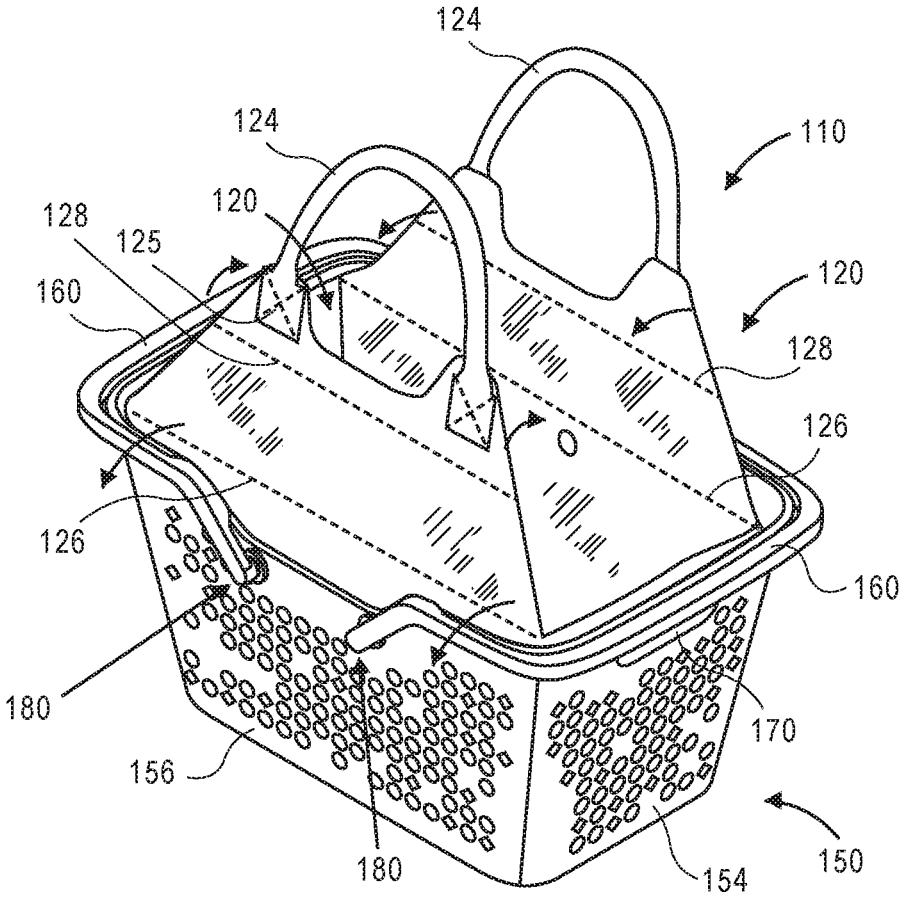
Figure 1H:
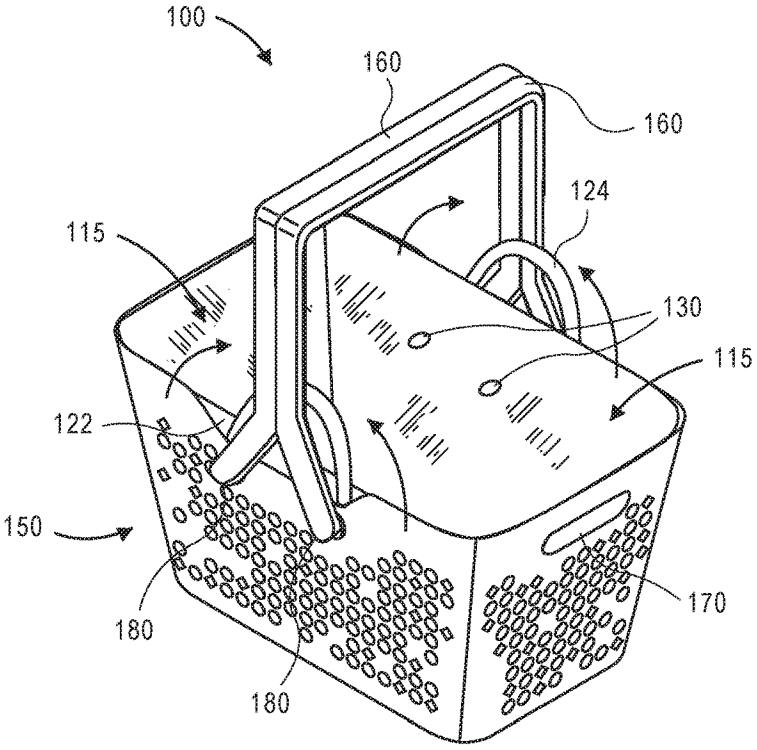
Figure 1G:
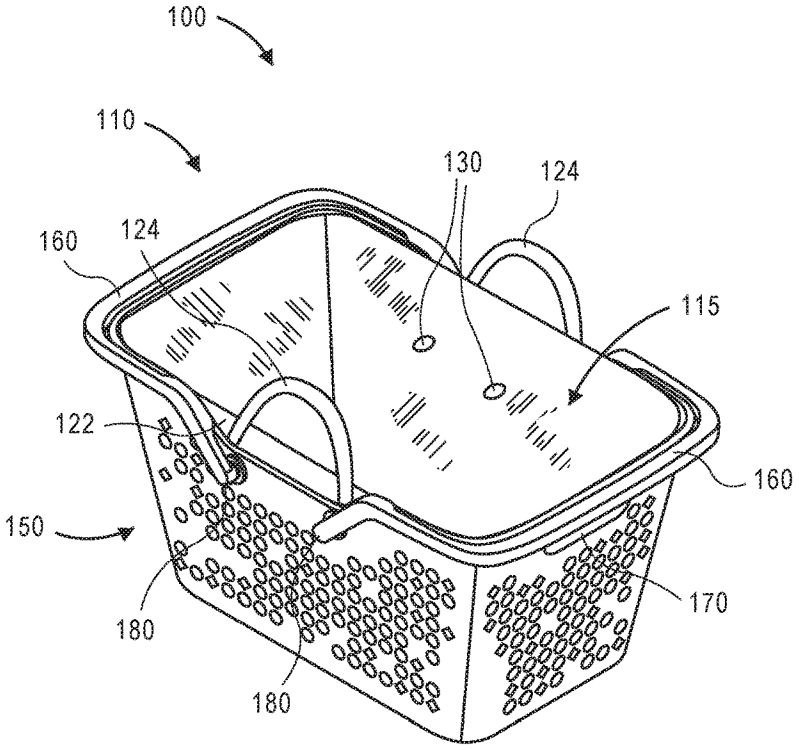

Accordingly, as is shown in FIG. 1F, the bag 110 may be nested within the basket 150 in a manner that causes the bag 110 to remain in place, such as by creasing portions of the handle sections 120 along the long sides 112 of the bag 110, e.g., along the scored lines 126 or the scored lines 128, and inserting the creased portions of the handle sections 120 between the long sides 112 of the bag 110 and the long sides 152 of the basket 150. When the handle sections 120 are folded and inserted between the long sides of the bag 110 and the long sides of the basket 150, such as is shown in FIG. 1G, the metallic elements 130 of the bag 110 are magnetically drawn or coupled to the magnetized elements 182 of the pivotable connections 180 of the basket 150, thereby providing at least a nominal magnetic force of friction to resist either an unintended removal of the bag 110 from the basket 150, or an undesired collapse of the bag 110 into the basket 150, during normal use of the combination carrying device 100. As is shown in FIG. 1H, once the bag 110 is properly nested within the basket 150, e.g., in the manner shown in FIG. 1G, the handles 160 may be pivoted upward about the pivotable connections 180, and a user may carry the combination carrying device 110 (e.g., both the bag 110 and the basket 150) together using the handles 160 throughout a materials handling facility, and deposit one or more items into the volume 115 defined by the bag 110. After the user has deposited one or more of the items into the volume 115, and no longer requires the use of the basket 150, e.g., when transitioning from picking to packing within a fulfillment center, or upon arriving at a checkout station of a retail establishment, the user may pivot the handles 160 downward, place one or more hands within the strap handles 124, and lift each of the handle sections 120, thereby extracting the bag 110 from the basket 150, while maintaining much of the structural integrity of the volume 115 of the bag 110.

In some implementations, the combination carrying devices of the present disclosure, including but not limited to the combination carrying device 100 of FIGS. 1A through 1H, may include bags or other like soft, flexible item carriers and baskets or other like firm, rigid item carriers, with the bags having external shapes and dimensions that are specifically selected to conform to interior shapes and dimensions of the baskets, such that the bags may be received within the baskets and maintained in place there by a magnetic force formed between at least a portion of the bags and at least a corresponding portion of the baskets. For example, the bags may be formed in tapered shapes having internal angles and external angles or other features that are substantially equal to their counterpart internal angles and external angles or other features of baskets, and include one or more dimensions that are slightly smaller than their counterpart dimensions of baskets, such that the bags may be simply and releasably nested within such baskets. The bags and the baskets may each include magnetically compatible components that, when placed within a close proximity of one another, are magnetically drawn or coupled to one another, e.g., when one of the metallic elements 130 of the combination carrying device 100 of FIGS. 1A through 1H is within a magnetic field produced by one of the magnetized elements 182, and a magnetic force between such components causes the bags to remain nested within the baskets. Where a shape and volume of a bag corresponds to a shape or volume of a basket, the magnetically compatible components are preferably disposed in both absolute and relative locations that are consistent with one another, such that the magnetically compatible components are drawn together or coupled only when the bag is properly nested within the basket. In some implementations, one or more of the magnetically compatible components may be provided in association with a rotatable connection of one of the handles to one of the baskets, e.g., the magnetized elements 182 of the pivotable connections 180, as is shown in FIGS. 1B and 1D through 1H.

The combination carrying devices of the present disclosure may thereby effectively join two carriers that are traditionally recognized as separate components, namely, a basket and a bag, in a manner that allows a user to seamlessly transition between exploiting the advantages of a basket, e.g., the strength and durability thereof, and the advantages of a bag, e.g., its portability and lightweight structure. The combination carrying devices further enable users to eliminate the requirement to transition picked items from a carrier or cart into a bag (e.g., when transitioning from picking to packing, or at a checkout station of a retail establishment), when the items to be transitioned are located in a basket, as the items are already placed within a volume of a bag that is releasably provided within a volume of the basket.

In accordance with the present disclosure, bags may be formed from flexible materials that define a cavity for receiving one or more objects therein, and may include handles extending from flaps provided along at least one side of the bags which enable the bags to be removed from the baskets, with the objects therein, when the items are to be transitioned from one state to another. According to some implementations, the handles may constitute substantially planar elements defined by chords, bases or segments which are connected to one or more flaps extending along opposing lengths of the bags. According to some other implementations, the bags may include pairs of straps or strap-like handles corresponding to different uses thereof. For example, a bag may include a pair of handles on opposing sides thereof, including a pair of long handles for carrying the bag about a shoulder or forearm, and a pair of short handles for carrying the bag by hand or for removing the bag from a basket in which the bag is nested. The handles of the present disclosure may include reinforcement stitching in selected locations thereof, including about all or a portion of a perimeter of an opening for a hand, arm or shoulder, or along all or a portion of a length of a strap.

Using one or more of the carrying devices disclosed herein, items may be transitioned from picking to packing, or from picking to a conveyor, at the conclusion of a working or shopping experience, or at another appropriate time. The baskets may be formed from one or more durable materials, and may be configured to receive and maintain the bags in place therein. Additionally, the baskets may be provided with two or more handles mounted along and outside of an upper perimeter, such that the handles do not interfere with the insertion or removal of the bags, and enable the baskets to be stored in a stack or other like arrangement, with bags interleaved therein.

For example, the bags may be formed from any type or form of flexible materials, e.g., one or more panels of such materials, including but not limited to knitted, woven or non-woven fabrics, natural or synthetic leathers or canvases, or other like materials that may be joined at one or more edges thereof, such as by stitching. Preferably, the materials from which the bags are formed are sufficiently structurally sound such that the bags remain erect even after the bags have been removed from their respective baskets, and are yet flexible enough to be folded and deposited within the baskets in a manner that causes the bags to be held in place therein. Additionally, the bags are preferably formed with rectangular cross sections and in tapered, frustopyramidal shapes that conform to interior volumes of the baskets in which the bags are placed.

In some implementations, the bags may be formed from one or more panels of fibrous fabrics that are formed at least in part from paper, cotton or recycled plastics, including but not limited to fabrics comprising blends of cotton or like natural materials and materials comprising recycled plastics, thereby providing the bags with enhanced hydrophobicity to repel liquids or other stain-forming matter. For example, in some implementations, the bags may be formed from non-woven plastic polypropylene materials, while in other implementations, the bags may be formed from woven fabrics including polypropylene or polyethylene fibers. Moreover, the bags may be formed from materials that are laminated on one or both sides thereof, and such materials from which the bags are formed may be selected on any basis. Laminating or otherwise reinforcing or protecting such materials enables the bags to be used, washed and reused on several occasions. For example, where the bags disclosed herein are intended to be reused by customers who received them from a retail establishment, or by the retail establishment that furnished the bags to the customers, such materials may selected based on their durability and capacity to withstand repetitive cleaning and reuse in a variety of environments.

The bags may also include handles provided on long sides thereof, within polygonal shapes or flaps extending along all or a portion of the long sides of the bag. Such shapes or flaps ensure that tensile forces provided by a customer who is holding a bag from above, by the handles, are evenly distributed throughout the length of the bag, and not concentrated about one or more likely points of failure. The handles may include one or more slots defined by elongated holes that are aligned substantially parallel to the long sides of the bag. Such slots may be may be reinforced, as necessary, with perimeter stitching.

Additionally, as is discussed above, the bags and baskets may include corresponding components for generating a magnetic force between one or more surfaces of a bag and one or more surfaces of a basket. For example, as is shown in FIGS. 1C and 1D, the bags of the present disclosure may include metallic elements inserted, stitched or otherwise disposed within or thereon at predetermined points or locations, and at a defined relationship to one another. Likewise, the baskets of the present disclosure may include magnetized elements mounted or otherwise affixed or adhered thereto, at corresponding points or locations and in a manner consistent with the defined relationship, such that when a bag is inserted into a basket, a magnetic force draws the metallic element toward the magnetized element, and maintains the bag nested in the basket. In accordance with the present disclosure, the magnetized elements may be any magnetized or magnetizable objects or substances capable of generating a magnetic field in the absence of an applied magnetic field, e.g., any magnetic or ferrous materials, including but not limited to iron, steel, cobalt, nickel or alloys including one or more of such materials, as well as one or more natural Earth or rare-Earth magnets (e.g., samarium cobalt magnets, neodymium iron boron magnets), composite magnets (e.g., ceramic magnets, "alnico" magnets, injection-molded magnets, magnetic polymers, flexible magnets) or any other substances that can possess magnetization or magnetic properties in the absence of a magnetic field below a Curie temperature. In accordance with the present disclosure, the metallic elements may be any unmagnetized ferromagnetic materials that demonstrate magnetic properties within the presence of a sufficiently strong magnetic field.

Furthermore, although the combination carrying device 100 of FIGS. 1A through 1H includes the metallic elements 130 provided on outer surfaces of the long sides 112 of the bag 110, and the magnetized elements 182 provided on inner surfaces of the long sides 152 of the basket 150, those of ordinary skill in the pertinent arts will recognize that the magnetized elements 182 or other magnetized components or substances may be provided on outer surfaces of bags, and that the metallic elements 130 or ferromagnetic components or substances may be provided on inner surfaces of baskets, in accordance with the present disclosure.

In accordance with the present disclosure, baskets may be formed in tapered, frustopyramidal shapes corresponding to such tapered, frustopyramidal shapes of the bags provided therein, and from plastic, wood, metal, natural materials or other durable materials that provide structural support and orientation of bags and the contents thereof. In some implementations, the baskets may be substantially solid, e.g., without holes or other perforations therein. In some other implementations, however, the baskets may be provided with slots or holes, in a regular or irregular lattice or other arrangement, e.g., perforated or latticed sides, corners, bottoms or other elements. Additionally, the baskets may include two or more handles that are provided on an upper perimeter and mounted to exterior surfaces thereof. According to some implementations, a pair of handles, each having lengths corresponding approximately to half of the upper perimeter may be mounted to central points about the upper perimeter with pivotable or rotatable connections, such that that ends of the handles may pivot or rotate about such points from a lowered position along the upper perimeter to a raised position where the ends may be joined above the baskets. Such handles may include one or more ergonomically designed features that are provided in order to enhance the comfort of a user who is transporting a combination carrying device using his or her hands or arms, such as perpendicular joints having rounded shapes.

According to some implementations, the handles may be mounted on outer surfaces of a basket, and provided about an upper perimeter of the basket, in a manner that enables each of the handles to pivot or rotate from a first position that closely conforms to the upper perimeter of the basket to a second position where the handles are joined above or about a center of the basket. For example, in some implementations, the handles may rest on or lie alongside or near an upper perimeter of a basket in the first position, while in some other implementations, the handles may extend beyond the upper perimeter when in the first position. Moreover, according to some other implementations, an upper perimeter of a basket may include a shelf or other rounded extension supported by one or more corbels or other supports provided at regular or irregular intervals of the upper perimeter for supporting the handles in the first position.

Additionally, the upper perimeter of the basket may include a central area along the long sides thereof having a tapered section with a reduced height or elevation. One or more handles may be mounted to outer surfaces of the basket at the central area, and may be provided in obtuse angles, such that the handles closely conform to the upper perimeter thereof in the first position, and may rotate upward to the second position. The long sides of the basket may include an angled mounting bore that is formed integral to the tapered, frustopyramidal shapes of the baskets (e.g., by injection molding or one or more other means), but includes one or more faces that are oriented substantially vertically and permit the handles to rotate from the first position to the second position within a substantially vertical plane. Moreover, in some implementations, the external faces of the long sides may include one or more mechanical stops (e.g., pegs or other extensions) associated with each of the handles which prevent such handles from pivoting or rotating a predetermined extent, e.g., a predefined angle, beyond the second position.

According to some implementations, the baskets of the present disclosure may include pivotable or rotatable handles formed of rounded and/or smoothed metals, plastics, composites or other like materials. The handles may include relatively thick or rigid portions corresponding to ends or extensions by which such handles are mounted or joined to a tapered basket, and comparatively thinner portions corresponding to regions that are intended for gripping by one or more users thereof. Additionally, the handles may also have lengths that correspond to portions of the upper perimeters of the baskets, as well as portions, which extend beyond or outside of the upper perimeters.

The pivotable or rotatable handles may be mounted to baskets using pivotable or rotatable connectors having portions extending through one or more bores provided in one or more sides of a basket. For example, a pivotable or rotatable handle may include an extension having a width that is less than a diameter of a bore formed within a side of a basket, and a length that is greater than a thickness of the side of the basket through which the bore is formed. Thus, such extensions may, when joined to a nut, a washer or other piece of fastening hardware, may define a channel that allows the extension to rotate freely and in a low-friction manner within the bore. In some other implementations, the fastening hardware may include a magnetized element aligned to come into contact with a corresponding metallic element of a bag when the bag is nested within the basket.

The pivotable or rotatable handles may further include mechanical stops or extensions having one or more planar components that are aligned to come into contact with one or more surfaces of an upper perimeter of a basket. The mechanical stops or extensions may include single planar components for contacting a single edge of an upper perimeter of a basket, or multiple planar components for contacting multiple edges of the upper perimeter of the basket. Moreover, depending on their positioning on the handles and the extent to which the handles may rotate or pivot, the mechanical stops or extensions may restrict the rotation of the handles between a first position closely conforming to an upper perimeter of a basket to a second position at which the handles are joined above or about a center of the basket.

According to some other implementations, the baskets of the present disclosure may further include one or more handles that are formed by cuts into one or more sides of the baskets, e.g., slots provided on corresponding sides, such as on two short sides or two long sides of the baskets. Such slots enable a user to manipulate a basket without requiring the use of one or more pivotable or rotatable handles mounted thereon.

The tapered, frustopyramidal shapes of the baskets, and the mounting of the handles along exterior surfaces thereof, enable combination carrying devices including such baskets to be stacked with or without bags provided therein. For example, two or more combination carrying devices having bags disposed in baskets may be stacked with the devices oriented upwardly, e.g., with openings of the volumes defined by such bags and baskets aligned in a vertically upward manner, such as is shown in the combination carrying device 100 of FIG. 1G, near an entrance to a materials handling facility. Users may retrieve one of the combination carrying devices upon arriving at the materials handling facility, carry the combination carrying device throughout the materials handling facility in search for items of interest, and place one or more of such items within a bag provided within a basket of the combination carrying device. When the user has completed a picking of the items, the user may remove the bag from the basket, and stack the basket near an exit of the materials handling facility, e.g., in a downward orientation, with the openings of the volumes defined by the basket aligned in a vertically downward manner.

In this regard, where combination carrying devices including bags releasably nested within baskets by magnetic force, two or more of the devices may be stacked atop one another, e.g., with a bottom of basket of one device being inserted into a volume of a bag of another device, and the each of the bags will remain nested within the baskets when a customer retrieves one of the combination carrying devices from the stack. Moreover, the magnetic force further ensures that when one of the combination carrying devices is removed from the stack, the bag will not remain attached to a basket provided beneath the combination carrying device in the stack, and ensure that the bag does not collapse within the basket.

Additional features and advantages of the combination carrying devices, and the bags or baskets associated therewith, are set forth in greater detail below.

Referring to FIGS. 2A through 2E, views of one bag 210 provided for use in a combination carrying device in accordance with implementations of the present disclosure are shown. Except where otherwise noted, reference numerals preceded by the number "2" shown in FIGS. 2A through 2E indicate components or features that are similar to components or features having reference numerals preceded by the number "1" shown in FIGS. 1A through 1H.

Figure 2A:
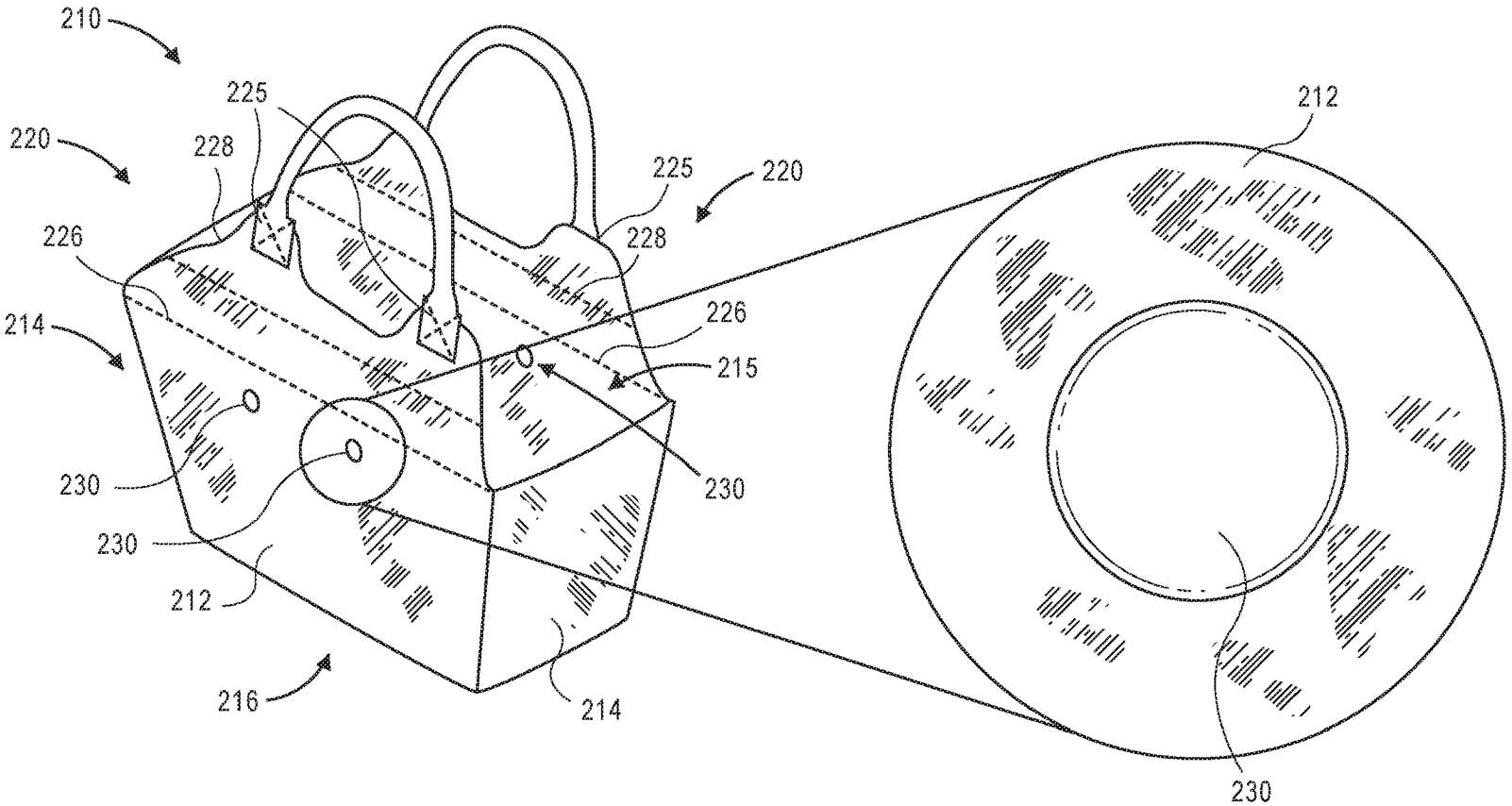
FIGS. 2A through 2E are views of one bag provided for use in a combination carrying device in accordance with implementations of the present disclosure.

As is shown in FIG. 2A, the bag 210 includes a pair of long sides 212, a pair of short sides 214 and a bottom 216. The long sides 212 and the short sides 214 extend vertically upward from the bottom 216, and define a tapered interior volume 215. Additionally, the bag 210 further includes a pair of handle sections 220, with each handle section 220 having a panel 222 joined to an upper edge of one of the long sides 212. Each of the handle sections 220 further includes a strap handle 224 having a size and orientation for accommodating a hand therein. Each of the handle sections 220 is also shown as having a scored line (or crease) 226 at which the handle section 220 is flexibly folded or bent, e.g., between the long sides 212 and the panel 222, as well as a scored line 228 that may accommodate one or more creases within the panel 222 when the bag 210 is folded for insertion into a corresponding basket. Additionally, each of the strap handles 224 is joined, at either end, to one of the panels 222 at a mount 225.

As is further shown in FIG. 2A, each of the long sides 212 of the bag 200 includes a pair of metallic elements 230, e.g., rivets, bolts and/or screws, or like components. The metallic elements 230 are spaced at a fixed interval on either of the long sides 212. The metallic elements 230 may have round or substantially flat surfaces extending from outer surfaces of the long sides 212 by a predetermined amount or extent. In accordance with the present disclosure, when the bag 210 is properly nested within a basket (not shown) having magnetized elements in corresponding orientations and positions on internal surfaces thereof, the bag 210 will remain nested within the basket when the metallic elements 230 are drawn or coupled to the magnetized elements by a magnetic force, until the magnetic force is overcome, e.g., by manually lifting the bag 210 out of the basket by one or more of the strap handles 224.

Also in accordance with the present disclosure, when the bag 210 is inserted into a basket (not shown) having magnetized elements in corresponding orientations and positions on internal surfaces, the bag 210 may be folded or creased at one or more locations in a manner that enables portions of the bag 210, e.g., the panels 222 of the handle sections 210, to be tucked between the long sides 212 and a corresponding side of the basket while maintaining the bag 210 nested therein.

Figure 2C:
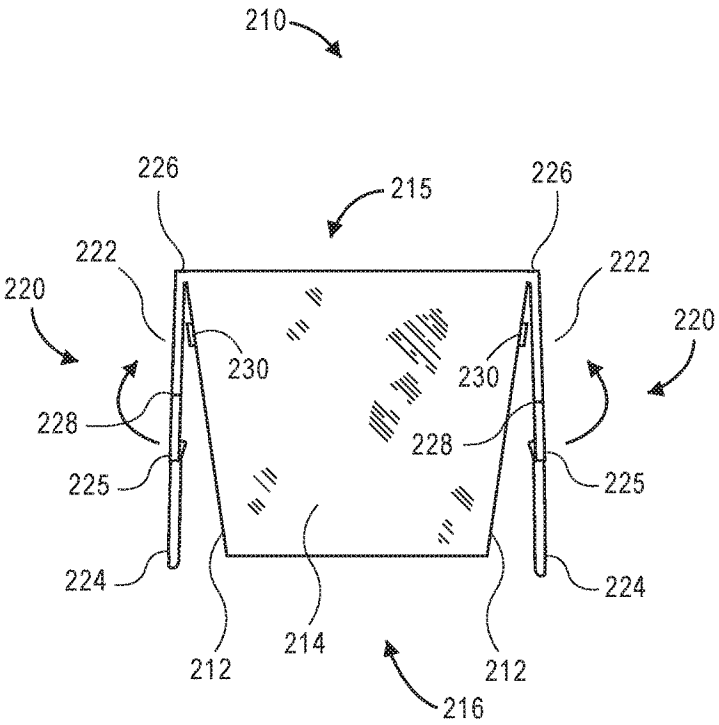
Figure 2B:
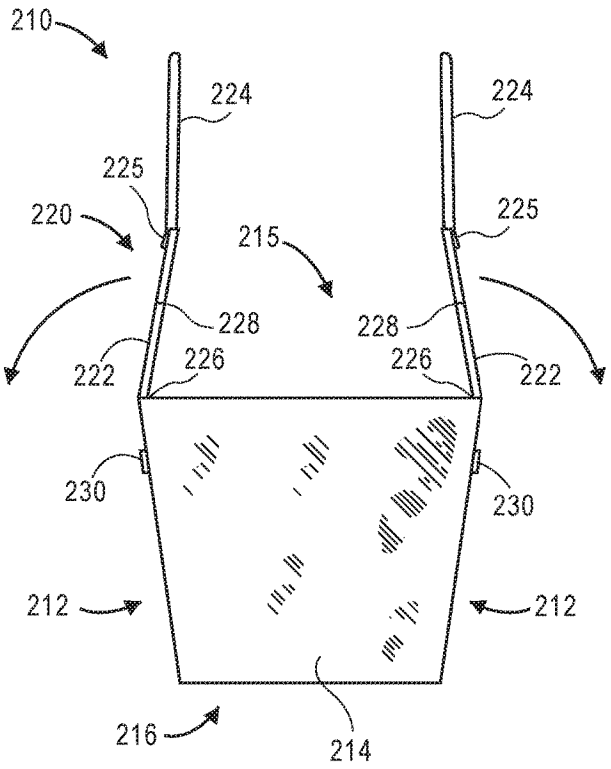
Figure 2E:
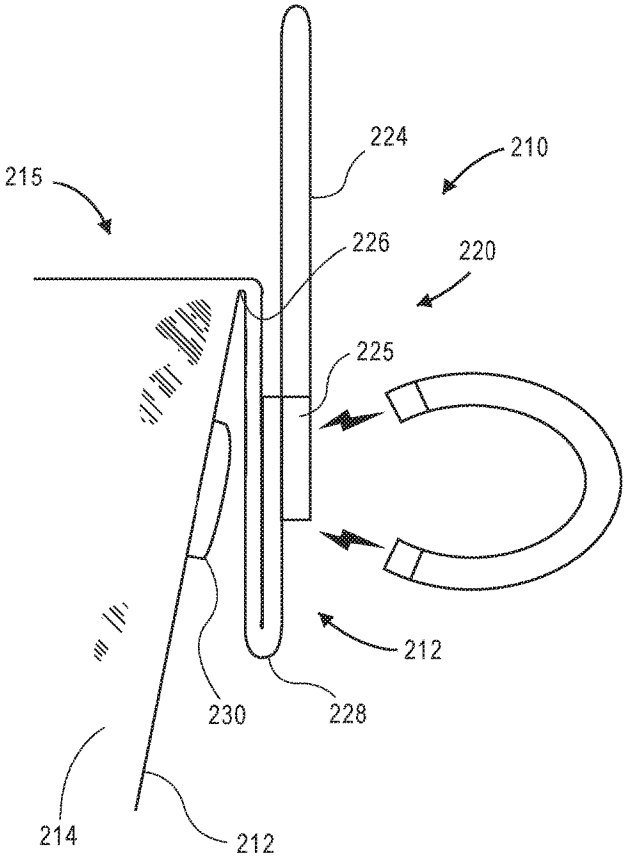
Figure 2D:
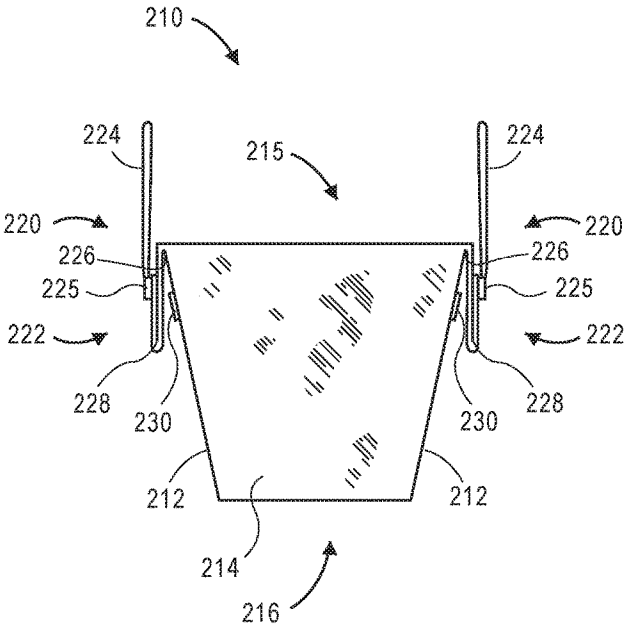

Referring to FIGS. 2B through 2E, side views of the bag 210 are shown. As is shown in FIG. 2B, each of the handle sections 220 may be folded downwardly and outwardly about the scored line 226. As is shown in FIG. 2C, after the handle sections 220 have been folded about the scored line 226, the panels 222 may be folded upwardly and inwardly about the scored line 228, until each of the handle sections 220 of the bag includes doubly folded panels 222, with portions of the strap handles 224 extending above the upper perimeter of the volume 215. In the folded configuration shown in FIG. 2D, the bag 210 may be inserted into a volume of the basket, and a combination carrying device including both the bag 210 and the basket may be provided to a user at a materials handling facility. The user may place one or more items within the volume 215 of the bag 210 and, after completing a transaction for the purchase of the items, lift the bag 210 from the basket by placing his or her hands within the strap handles 224 and raising the bag 210 and the items therein by the handle sections 220.

Those of ordinary skill in the pertinent arts will recognize that the bags provided in the combination carrying devices of the present disclosure may be formed from any number of panels of appropriate fabric-based materials, including one or more knitted, woven or non-woven fabrics, as well as natural or synthetic leathers, canvases or other like materials. For example, referring again to FIGS. 2A through 2E, materials from which the bag 210 is formed may be selected to ensure that the metallic elements 230 may be subjected to magnetic forces when the metallic elements 230 are within a magnetic field produced by one or more components of a basket, and drawn into contact with an inner surface of the basket by such forces, even when such materials are folded into one or more layers. The materials from which bags are formed may be stitched together at appropriate locations to form one or more seams. Additionally, reinforcement stitches, or any other type or form of reinforcement, may be provided, where necessary, to enhance the durability and survivability of such bags during and after use thereof. Although the handles 124 of the bag 110 shown in FIGS. 1A through 1H and the handles 224 of the bag 220 shown in FIGS. 2A through 2E are formed from straps, those of ordinary skill in the pertinent arts will recognize that such handles may be formed of materials having any shape or thickness. In some implementations, the handles may be straps formed from continuous arcs such as portions of circles, parabolas or ellipses, as well as discontinuous shapes such as portions of squares, rectangles or triangles. In some other implementations, handles may be formed within substantially planar sections, e.g., the panels 122, 222 shown in FIGS. 1A through 1H and FIGS. 2A through 2E, joined to one or more of the long sides of a bag. For example, a slot-like opening may be cut or carved into a panel, and may serve as a handle, such that a separate strap-like feature or other attachment or extension need not be required. Some such shapes may include, but are not limited to, hemispheres, rectangles, triangles, trapezoids or others. Furthermore, the bags of the present disclosure, such as the bag 110 shown in FIGS. 1A through 1H or the bag 220 shown in FIGS. 2A through 2E, may also be provided with a variety of handles for different purposes, including but not limited to short handles for enabling a user to extract the bag and any items therein from a basket, or to carry the bag and any items herein using his or her hands, or long handles for enabling a user to carry a bag using his or her shoulders or forearms, e.g., after the bag and any items therein have been extracted from a basket, such as at the conclusion of any picking or shopping experience.

Additionally, according to some implementations of the present disclosure, the bags may be formed in a single-piece construction from a piece of fabric that is properly cut and shaped, and may be subsequently stitched or joined in order to define a volume that corresponds to an interior of a basket and may be nested therein. A single piece of material may include panels or subsections corresponding to sides and a bottom of a bag, including panels or subsections corresponding to the long sides 112, the short sides 114 or the bottom 116 of the bag 110 of FIG. 1A. When such subsections are joined together at their respective sides or edges, e.g., by stitching, gluing, bonding or the like, using one or more adhesives, the single piece of material will define a volume, such as the volume 115 of the bag 110 of FIG. 1A, that may be nested within a basket, such as the basket 150 of FIG. 1B, and accommodate one or more items therein. Those of ordinary skill in the pertinent arts will recognize, however, that the bags of the present disclosure may be formed from any number of pieces of fabric or other sufficiently strong materials, and in any manner, and are not limited to construction from single pieces.

The baskets and bags disclosed herein may be formed of any size and may have any dimensions. For example, in one implementation, a basket may have a height of approximately ten to fifteen inches (10-15"), a length of approximately twelve to twenty-four inches (12-24") and a width of approximately nine to eighteen inches (9-18"), and may define tapered volumes for receiving and nesting a bag therein. Such baskets may further include rotatable handles having a maximum length of approximately six to nine inches (6-9"). The bags may have any heights, lengths, widths or volumes corresponding to the heights, lengths, widths or volumes of the baskets, and may be sized to be accommodated within such baskets.

As is discussed above, the handles of the baskets of the combination carrying devices disclosed herein may have lengths corresponding to upper perimeters of volumes defined by such baskets, and may be rotatably mounted and aligned near a center of a long side of the baskets along the upper perimeters, such that the handles may be rotated upwardly and inwardly to enable the combination carrying devices to be carried by a user, or downwardly and outwardly to enable the bags to be removed from the baskets or to enable the baskets to be stacked. The rotatable mounting and alignment of the handles further may provide additional clearance for items that are substantially taller than either of the long sides or the short sides of the baskets to be carried within bags nested therein, such that a maximum height of an item that may be carried within a basket may be defined by a sum of a depth of the basket and an interior radial length of the handle. For example, where the basket has a depth of approximately twelve inches (12"), and the handle has an interior radial length of approximately eight inches (8"), items having heights of up to approximately twenty inches (20") may be accommodated within the basket in a central region thereof. A largest item of a plurality of items may be positioned substantially centrally within a volume of a bag nested in a basket of a combination carrying device, such that handles of the basket may be rotated from an area near an upper perimeter of the basket upwardly and inwardly and joined above the items with sufficient clearance, and such that a user may grasp the handles and carry the combination carrying device thereby.

As is discussed above, the combination carrying devices of the present disclosure may include baskets having handles mounted to outer surfaces of the baskets on opposing sides via pivotable or rotatable connections, and magnetic components mounted to inner surfaces of the baskets that are aligned to correspond with corresponding components provided on outer surfaces of bags to be nested therein. The handles of the baskets may be specifically shaped and mounted to a basket such that the handles may rest on or lie alongside or near an upper perimeter of the basket when folded down, e.g., into a first position, and may be joined together when folded upwardly to a point substantially over a centroid of the basket, e.g., at a second position, when the basket is in use.

Referring to FIGS. 3A through 3D, views of one basket 350 for use in embodiments of combination carrying devices in accordance with the present disclosure are shown. Except where otherwise noted, reference numerals preceded by the number "3" shown in FIG. 3A through 3D indicate components or features that are similar to components or features having reference numerals preceded by the number "2" shown in FIG. 2A through 2E, or by the number "1" shown in FIGS. 1A through 1H.

The basket 350 includes a pair of long sides (or side panels) 352, a pair of short sides (or end panels) 354 and a bottom (or bottom panel) 356 formed in a tapered, frusto-pyramidal shape defining a volume 355. As is shown in FIGS. 3A through 3D, the volume 355 has a substantially rectangular horizontal cross-section with areas of descending size, from top to bottom, beginning with an area defined by upper edges of the long sides 352 and the short sides 354, and concluding with an area of the bottom 356.

Figure 3A:
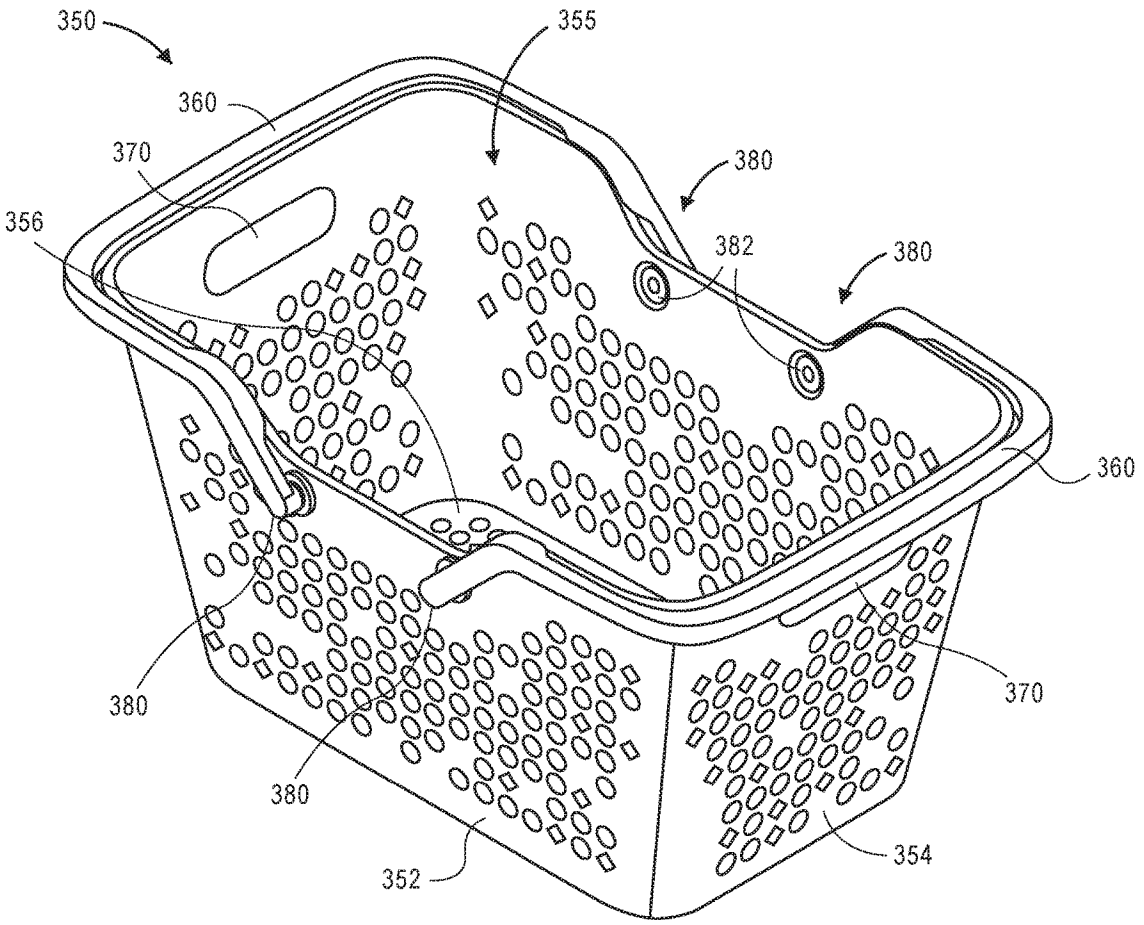
FIGS. 3A through 3D are views of one basket provided for use in a combination carrying device in accordance with implementations of the present disclosure.
Figure 3C:
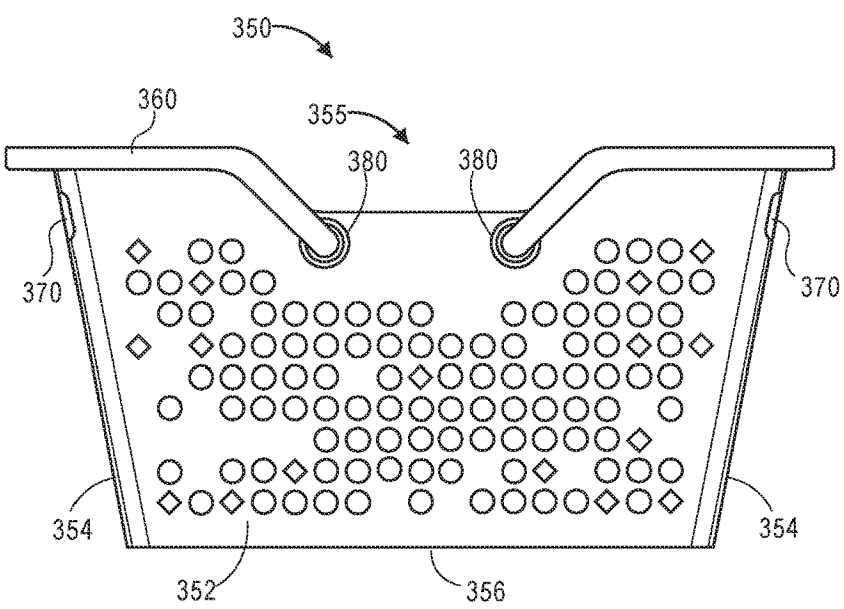

As is also shown in FIGS. 3A and 3C, the long sides 352 of the basket 350 each have end portions having heights that are substantially equal to the heights of the short sides 354, and central portions having heights that are substantially shorter than the heights of the short sides 354, with angled, slanted, curved or tapered portions connecting the end portions and the central portions. Thus, an upper perimeter of the basket 350 includes a pair of end sections or levels at a first height (e.g., a height of the short sides 354 and the end portions of the long sides 352), a pair of central sections or levels at a second height (e.g., a height of the central portions of the long sides 352), and angled sections or levels extending between the end sections or levels and the central sections or levels (e.g., a height of the angled portions of the long sides 352).

Figure 3B:
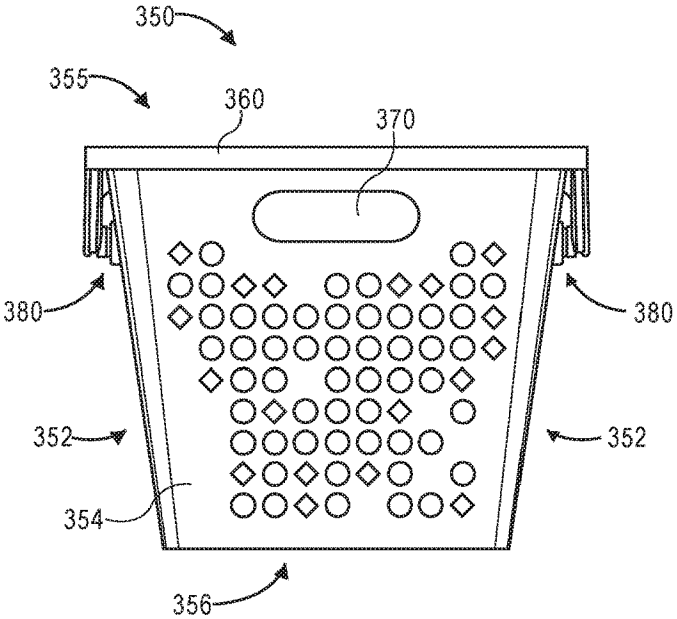
Figure 3D:
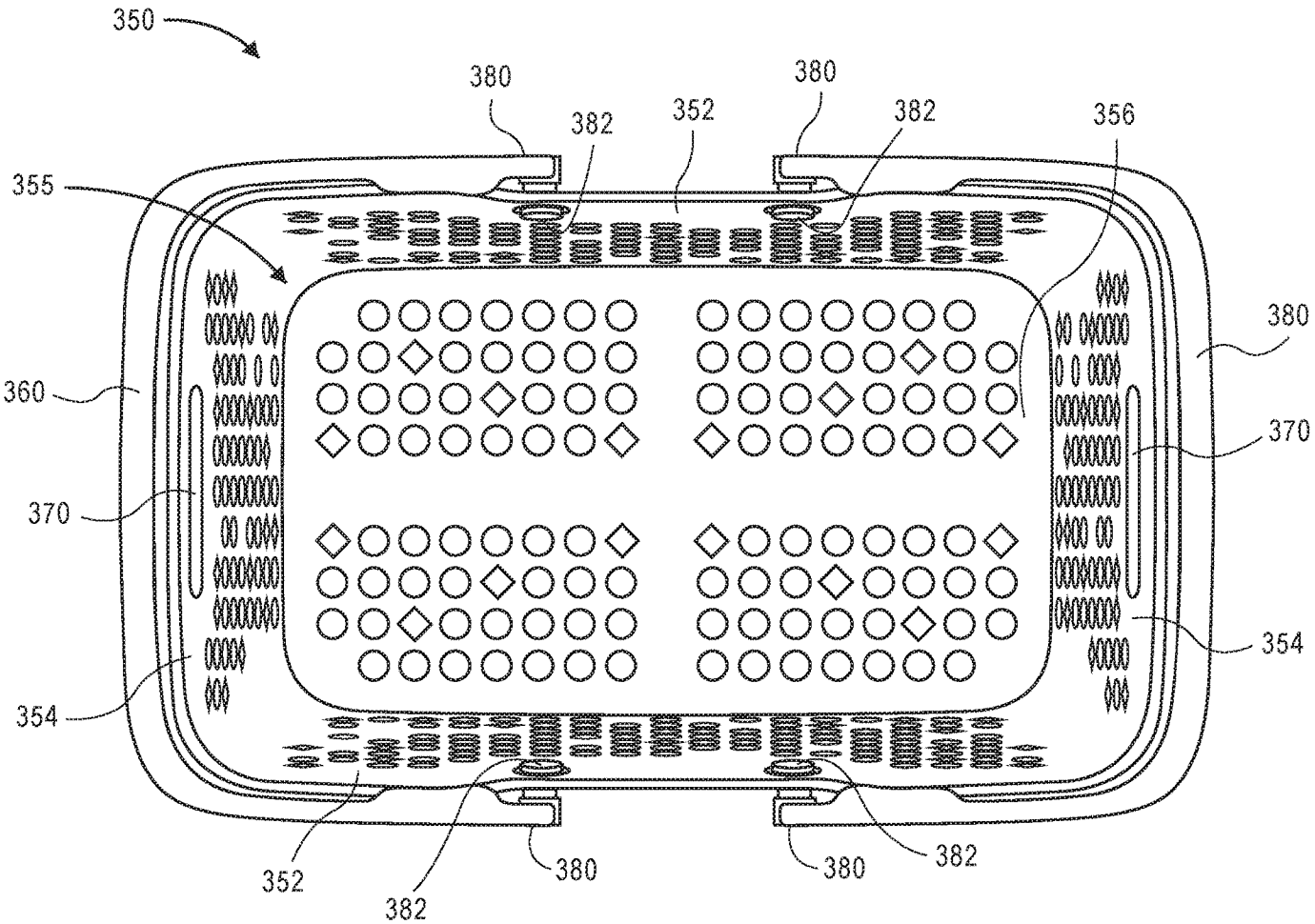

Although the basket 350 of FIGS. 3A and 3B is formed from two long sides 352, two short sides 354 and a bottom 356, with each of the long sides 352, each of the short sides 354 and the bottom 356 being substantially polygonal in shape and substantially planar in form, those of ordinary skill in the pertinent arts will recognize that the baskets 350 of the present disclosure need not be formed from four substantially planar polygonal sides and/or with a single substantially planar polygonal bottom. For example, referring again to FIG. 3A, the long sides 352 and the short sides 354 need not intersect at straight lines, and may, in some implementations, include one or more intervening surfaces (e.g., a corner panel in the form of a flat or rounded section extending between and joining a long side 352 and a short side 354) between them. Moreover, those of ordinary skill in the pertinent arts will further recognize that the intersections between the various sides or the bottom (e.g., the intersection between a long side 352 and a short side 354, or between either a long side 352 or a short side 354 with one or more intervening surfaces) need not be defined by single line segments. For example, in some implementations, the intersections between such sides and/or surfaces or the bottom may comprise one or more straight or curvilinear segments joining the various sides, surfaces or bottom of the baskets to one another.

Furthermore, where a basket is formed with various intervening surfaces between long sides or short sides, with sides or bottoms of shapes other than polygons or in non-planar (e.g., curved) forms, or with intersections of one or more straight or curvilinear segments, a bag that is intended to be nested within the basket may be similarly formed with sides, surfaces or a bottom of a similar shape or form, and with intersections of similar straight or curvilinear segments, such that the bag defines a volume corresponding to a volume of the basket.

As is further shown in FIGS. 3A through 3D, the basket 350 further includes a pair of pivotable handles 360 and a pair of slotted handles 370. Each of the handles 360 has a shape that corresponds to shapes of portions of the upper perimeter of the basket 350, and is mounted or otherwise attached on opposite long sides 352 of the basket 350 by pivotable connections 380, e.g., provided about or near the central portions of the long sides 352. Each of the pivotable connections 380 extends laterally outward from an outer surface of one of the long sides 352, and includes one or more components (e.g., fasteners) passing through a bore provided in the one of the long sides 352 that are joined to a magnetized element 382 disposed on an inner surface through the one of the long sides 352.

The pivotable connections 380 allow the handles 360 to pivot or rotate between a first position, such as is shown in FIGS. 3A through 3D, e.g., where each of the handles 360 is folded down and in contact with the upper perimeter of the basket 350, and a second position (not shown), e.g., where the handles 360 are folded up and in contact with one another, substantially above a centroid of the basket 350 and/or the volume 355. In some implementations of the present disclosure, the handles 360 may be formed from any suitable materials, such as plastics, wood, metals, composites or other durable materials that may be gripped by a user and may support the weight of the baskets 350 and any contents provided therein. Additionally, in accordance with other implementations of the present disclosure, the handles 360 may have any suitable length with respect to one or more dimensions of the baskets 350, in order to accommodate objects of varying sizes or shapes within the volume 355. The baskets 350 and/or the handles 360 may include one or more extensions or mechanical stops for preventing, restricting or defining the rotation of the handles 360 to a predetermined extent. The handles 360 may also include grips in sizes or shapes that may be functionally joined together when the handles 360 are pivoted or rotated above the volume 355 defined by the basket 350. Such handles 360 may further include one or more flat or rounded surfaces that may provide a more comfortable feel when the handles 360 are used to carry the basket 350, either singly or jointly. Additionally, the slotted handles 370 are fixed openings within the short sides 354 that may accommodate hands or other body parts of a worker.

Additionally, as is shown in FIGS. 3A through 3D, the handles 360 that are mounted or otherwise attached to external sides of the baskets 350 by the pivotable connections 380 may have one or more dimensions (e.g., lengths) which cause the handles to extend beyond the upper perimeters of the baskets when the handles 360 are in the position shown in FIGS. 3A through 3D. The extended lengths of the handles 360 permit bags to be nested within the baskets 350 when the handles 360 are folded down onto or near the upper perimeters of the baskets 350, and may further expand the carrying capacity of such baskets when the handles are folded upward.

Figure 4:
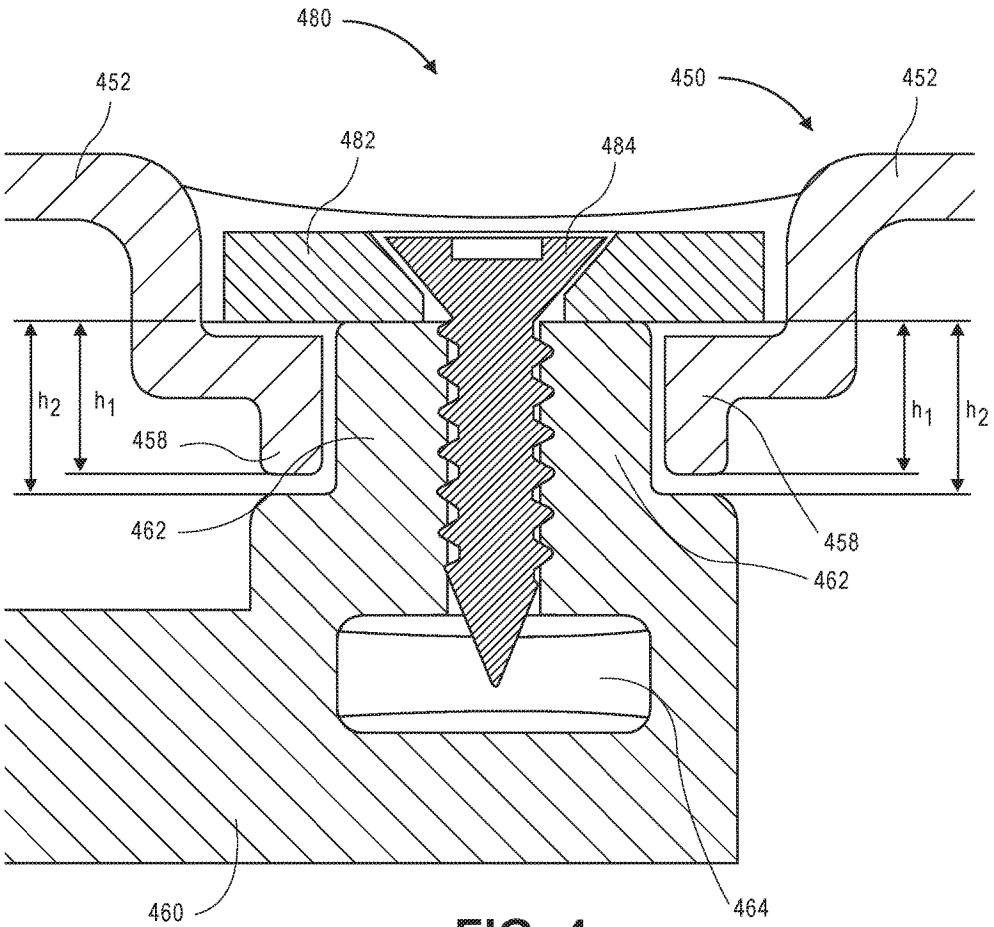
FIG. 4 is a view of one component of one basket provided for use in a combination carrying device in accordance with implementations of the present disclosure.

Referring to FIG. 4, a view of one pivotable or rotatable connection 480 for use in a combination carrying device in accordance with implementations of the present disclosure is shown. Except where otherwise noted, reference numerals preceded by the number "4" indicate components or features that are similar to components or features having reference numerals preceded by the number "3" shown in FIG. 3A through 3D, by the number "2" shown in FIG. 2A through 2E, or by the number "1" shown in FIGS. 1A through 1H.

As is shown in FIG. 4, the pivotable connection 480 is provided to join a handle 460 to a long side 452 of a basket 450. The handle 460 includes an extension 462 passing through a bore 458 provided in the long side 452 of the basket 450. A magnetized element 482 in the form of an annular disk having a width greater than a width of the bore 458 is joined via a fastener 484 to the extension 462, which has a width that is less than a width of the bore 458. The fastener 484 is tightly fit into an opening in the extension 462 and extends to a void 464 within the handle 460, and thus defines the pivotable connection 480 of the handle 460 to the basket 450. The fastener 484 may be a threaded bolt or screw, a barbed stud, or any other like device for tightly binding the magnetized element 482 to the extension 462 of the handle 460. In some implementations, the pivotable connection 480 may further include one or more washers (not shown) or like annular device formed from materials such as metal, rubber or plastic for evenly distributing pressures between the fastener 484 and the extension 462 upon tightening. Furthermore, where the fastener 484 and/or any washers or other components provided in association with the pivotable connection 480 are formed from ferromagnetic materials, such components may ultimately be magnetized by the magnetized element 482, thereby enhancing the capacity of the basket 450 to receive and nest a bag including one or more correspondingly aligned metallic elements (not shown) therein.

Moreover, dimensions of the extension 462 enable the handle 460 to rotate freely and in a low-friction manner within the bore 458, regardless of the pressure or tightness of the fit between the fastener 484 and the extension 462. As is shown in FIG. 4, a height $h_1$ of the bore 458 is less than a height h2 of the extension 462, thereby enabling the handle 460 to freely rotate with respect to the basket 450 about an axis defined by the pivotable connection 480. In some implementations, a difference between the height $h_1$ of the bore 458 and the height h2 of the extension 462 may be approximately one millimeter (1 mm).

As is discussed above, the bore 458 may be associated with the long side 452 in any manner. For example, in some implementations, the bore 458 may be formed integral to the long side 452 of the basket 450 by injection molding, or by any means by which the basket 450 is formed. Alternatively, the bore 458 may be an independent implement that is mechanically joined to the long side 452 after the baskets 450 have been formed.

The bore 458 is a substantially cylindrical opening provided on the long side 452 and extending between an interior of the basket 450 and an exterior of the basket 450. The bore 458 may include one or more flanges or collars that are sized and shaped to correspond with and accommodate the fastener 458 extending therethrough. Whereas the long side 452 of the basket 450 may be provided at an obtuse angle with respect to the bottom (not shown) of the basket 450, thereby defining the tapered, frustopyramidal volume of the basket 450 at least in part, the bore 458 may be provided with flat faces that are substantially vertical, e.g., perpendicular to the bottom, and with openings that are substantially horizontal, e.g., parallel to the bottom. Thus, when the handles 460 is mounted or attached to the basket 450 by way of the fastener 484 (e.g., one or more connectors such as threaded bolts or screws, rivets or like components) inserted into the bore 458, the substantially vertical flat faces of the bore 458 may enable the pivotable connection 480 to pivot or rotate in planes that are parallel to the flat faces of the bore 458, and perpendicular to the bottom.

As is discussed above, when a combination carrying device includes a bag nested within a basket and secured therein by magnetic force, one or more items within a materials handling facility may be deposited into a volume defined by the bag. After such items have been deposited into the volume, and when the basket is no longer required, e.g., when transitioning from picking to packing within a fulfillment center, or upon arriving at a checkout station of a retail establishment, the user may raise the bag out of the basket by one or more handles provided on the bag, thereby extracting the bag from the basket, with the items within the bag, once the lifting force provided by the user exceeds the magnetic force that secures the bag within the basket.

Figure 5B:
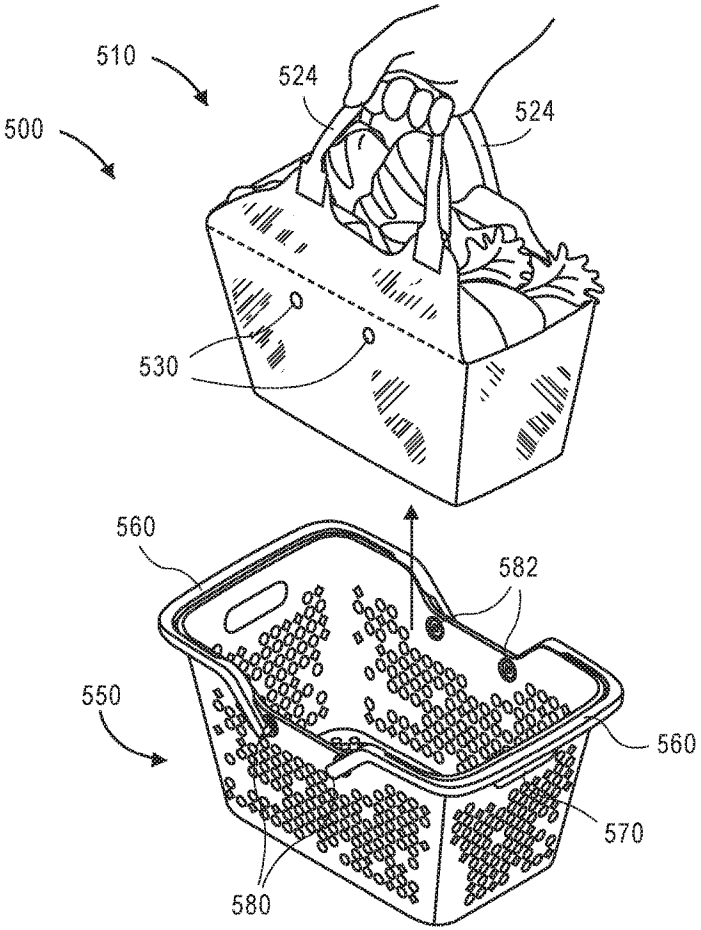
FIGS. 5A and 5B are views of aspects of one combination carrying device in accordance with implementations of the present disclosure.
Figure 5A:
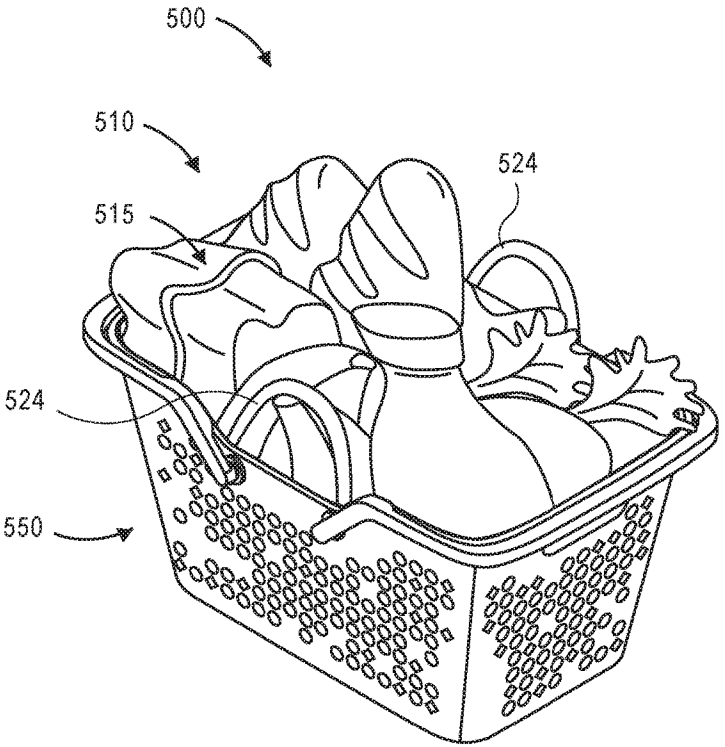

Referring to FIGS. 5A and 5B, views of aspects of one combination carrying device 500 in accordance with implementations of the present disclosure are shown. Except where otherwise noted, reference numerals preceded by the number "5" shown in FIG. 5A and FIG. 5B indicate components or features that are similar to components or features having reference numerals preceded by the number "4"

shown in FIG. 4, by the number "3" shown in FIG. 3A through 3D, by the number "2" shown in FIG. 2A through 2E, or by the number "1" shown in FIGS. 1A through 1H.

As is shown in FIG. 5A, the combination carrying device 500 includes a bag 510 nested within a basket 550. The bag 510 defines a volume 515 having a plurality of items 505 deposited therein, and includes a pair of handles 524 folded between an outer surface of the volume 515 and an inner surface of the basket 550, which includes a pair of pivotable handles 560. For example, a user of the combination carrying device 500 may carry the bag 510 and the basket 550 in tandem by folding the handles 560 upward and grasping the handles 560 with one or more hands, such as is shown in FIG. 1H, or inserting one or more arms beneath the handles 560, as the user searches throughout a materials handling facility for one or more items. After one or more desired items have been deposited into the volume 515, the handles 524 of the bag 510 may be grasped using one or more hands of the user, and the bag 510 may be extracted from the basket 510 with the items therein, such as is shown in FIG. 5B. The construction of the bag 510, e.g., the shapes and dimensions of the various panels, enables the bag 510 to maintain at least some of the structural integrity of the volume 515 as the bag 510 is removed from the basket 550 and carried by the handles, e.g., by one or more users.

As is further discussed above, the symmetric construction of some implementations of the combination carrying devices of the present disclosure enables two or more the combination carrying devices to be conveniently stored in a stack. For example, two or more combination carrying devices having bags disposed in baskets may be stacked with the devices oriented upwardly, e.g., with openings of the volumes defined by such bags and baskets aligned in a vertically upward manner, such as is shown in the combination carrying device 100 of FIG. 1G, near an entrance to a materials handling facility. A user may retrieve one of the combination carrying devices from the stack upon his or her arrival at the materials handling facility by lifting a top one of the devices, e.g., by one or more handles provided thereon. Referring to FIGS. 6A through 6D, views of combination carrying devices 600A, 600B, 600C, 600D, 600E in accordance with implementations of the present disclosure are shown. Except where otherwise noted, reference numerals preceded by the number "6" shown in FIGS. 6A through 6D indicate components or features that are similar to components or features having reference numerals preceded by the number "5" shown in FIG. 5A and FIG. 5B, by the number "4" shown in FIG. 4, by the number "3" shown in FIG. 3A through 3D, by the number "2" shown in FIG. 2A through 2E, or by the number "1" shown in FIGS. 1A through 1H.

Figure 6B:
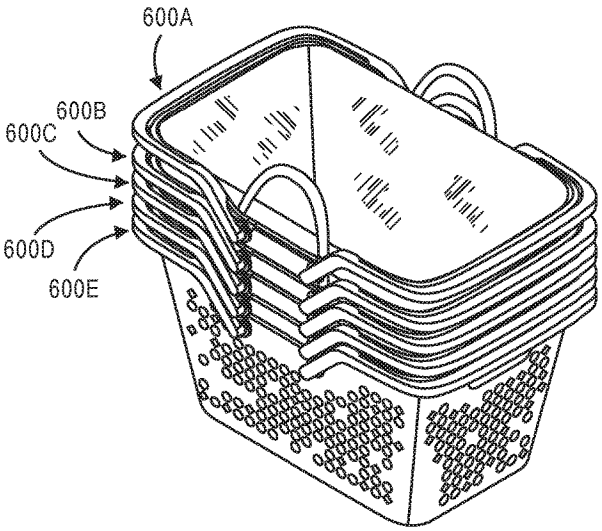
FIGS. 6A through 6D are views of combination carrying devices in accordance with implementations of the present disclosure.
Figure 6A:
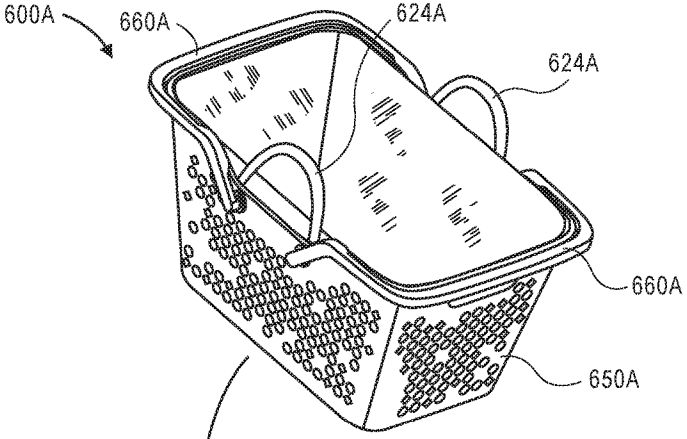
Figure 6A:
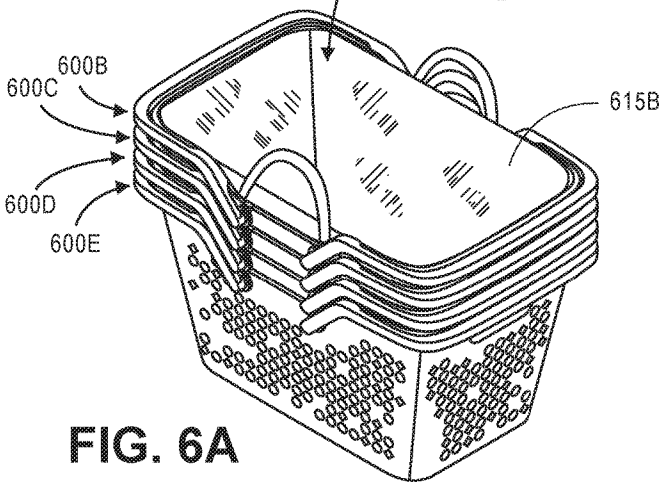

As is shown in FIG. 6A, the combination carrying device 600A includes a bag 610A nested within a basket 650A. The bag 610A includes a pair of handles 624A provided on opposite sides of the bag 610A that are nested within the basket 650A, e.g., between outer surfaces of the bag 610A and inner surfaces of the basket 650A. The basket 650A includes a pair of pivotable handles 660A mounted external to opposing sides of the basket 650A. As is further shown in FIG. 6A, the combination carrying devices 600B, 600C, 600D, 600E are provided in a stack, with the corresponding handles of the combination carrying devices 600C, 600D, 600E being wrapped around the handles of the combination carrying devices 600B, 600C, 600D inserted therein.

The combination carrying device 600A may be easily added to a stack of combination carrying devices 600B, 600C, 600D, 600E, e.g., by inserting the basket 650A of the combination carrying device 600A into a volume 615B defined by the combination carrying device 600B, such as is shown in FIG. 6A. As is shown in FIG. 6B, the combination carrying device 600A is shown atop a stack that includes the combination carrying devices 600B, 600C, 600D, 600E. Each of the combination carrying devices 600A, 600B, 600C, 600D, 600E is unaffected as a result of the process by which such devices was stacked, and each of the bags of such devices remains nested within a corresponding basket.

Figure 6D:
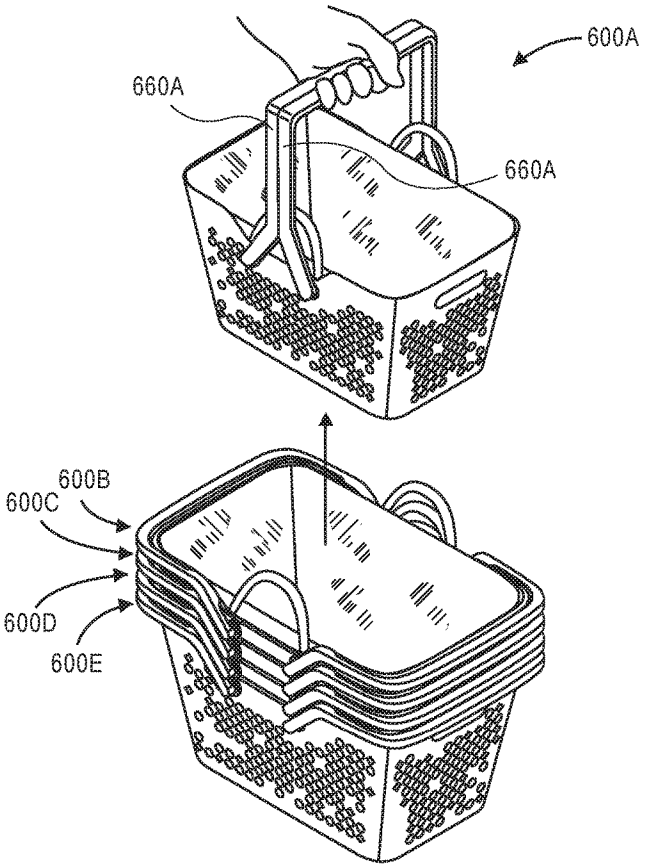
Figure 6C:
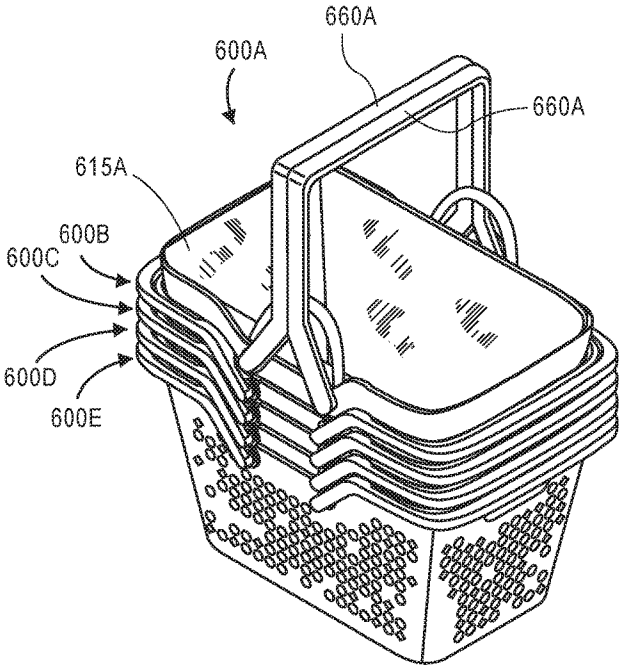

As is shown in FIG. 6C, when the combination carrying device 600A is to be removed from the stack of the combination carrying devices 600B, 600C, 600D, 600E, the handles 660A of the combination carrying device 600A may be rotated vertically upwardly, above the volume 615A defined by the bag 610A. Thereafter, as is shown in FIG. 6D, the combination carrying device 600A may be lifted from the stack, and the combination carrying devices 600B, 600C, 600D, 600E may remain in place. Each of the combination carrying devices 600A, 600B, 600C, 600D, 600E is unaffected as a result of the process by which the combination carrying device 600A was removed from the stack, and each of the bags of the combination carrying devices 600A, 600B, 600C, 600D, 600E remains nested within a corresponding basket.

As is discussed above, in some implementations, the combination carrying devices 600A, 600B, 600C, 600D, 600E may include holes, openings or perforations extending therethrough in a regular pattern or lattice, or irregularly. Such holes, openings or perforations permit air pressure or volumes that accumulate when a combination carrying device is inserted into one or more other combination carrying devices in a stack to dissipate through the holes, openings or perforations extending through the respective combination carrying devices in the stack, thereby ensuring that the bags nested within the baskets of such devices may remain in place as the combination carrying devices are stacked. Conversely, when one of the combination carrying devices is to be removed from the stack, the holes, openings or perforations may overcome any vacuum that may form between two or more of such devices as a combination carrying device is being removed, thereby ensuring that the bags nested within the baskets of such devices may remain in place as one of the combination carrying devices is removed.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. For example, although some of the implementations of the combination carrying devices disclosed herein include bags and baskets having corresponding frustopyramidal volumes, the present disclosure is not so limited, and bags and baskets having any corresponding shape or volume, e.g., any type or form of polyhedron or other three-dimensional shape. In some implementations, the combination carrying devices of the present disclosure may include bags and baskets having corresponding frustoconical volumes, e.g., hollow cavities having shapes corresponding to a frustrum of a cone, or a conic frustrum, for receiving one or more items therein. Alternatively, the combination carrying devices of the present disclosure may include bags and baskets having tapered volumes which correspond to one another, e.g., with corresponding cross-sectional shapes and/or areas and one or more continuous surfaces. For example, in some implementations, the bags and baskets may each feature volumes having ellipsoidal, circular, triangular, hexagonal or other regularly or irregularly shaped cross-sections that correspond to one another. The dimensions, types or sizes of the cross-sectional areas or shapes of the bags and baskets of the combination carrying devices disclosed herein are not limited. Furthermore, while some of the labels assigned to sides or panels of the bags or baskets described herein may represent lengths or positions (e.g., "long" or "short"), other labels may be purely arbitrary (e.g., "side" or "end").

Additionally, the bags of the present disclosure are also not limited for use in connection with non-wheeled baskets, such as those discussed herein. Rather, one or more of the bags disclosed herein may be releasably nested within a wheeled cart or other like apparatus, and may feature a volume that corresponds to a volume of the cart or other apparatus. One or more outer surfaces or panels of such bags, and one or more inner surfaces or panels of such carts, may include magnetically compatible components that are coaligned when such bags are nested within volumes of such carts, and are drawn or coupled together accordingly by magnetic force. In this regard, when a user has completed the picking of items into the cart, the user may simply extract the bag from the cart by lifting the bag using one or more handles provided thereon to overcome the magnetic force therebetween.

Moreover, although some of the baskets of the present disclosure are described as having handles that may pivot or rotate about axes defined by pivotable or rotatable connections between a first position and a second position, the baskets disclosed herein are not so limited. Rather, the handles may pivot or rotate to any position between an upper perimeter of a basket and a position located substantially above a centroid or midpoint of the basket, along a continuous or substantially continuous arc.

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain implementations could include, or have the potential to include, but do not mandate or require, certain features, elements and/or steps. In a similar manner, terms such as "include," "including" and "includes are generally intended to mean "including, but not limited to." Thus, such conditional language is not generally intended to imply that features, elements and/or steps are in any way required for one or more implementations or that one or more implementations necessarily include logic for deciding, with or without user input or prompting, whether these features, elements and/or steps are included or are to be performed in any particular implementation.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. A rigid item carrier comprising:

a first side panel;

a second side panel opposite the first side panel;

a first end panel joined to the first side panel and the second side panel;

a second end panel opposite the first end panel, wherein the second end panel is joined to the first side panel and the second side panel;

a first bottom panel, wherein each of the first side panel, the second side panel, the first end panel and the second end panel is joined to the first bottom panel;

a first handle having a first end and a second end, wherein the first end is pivotably attached to an outer surface of the first side panel by a first extension passing through the first side panel, and wherein the second end is pivotably attached to an outer surface of the second side panel by a second extension passing through the second side panel;

a first magnetized element joined to the first extension by a first fastener on an inner surface of the first side panel at a predetermined distance above the first bottom panel; and a second magnetized element joined to the second extension by a second fastener on an inner surface of the second side panel at the predetermined distance above the first bottom panel.

2. The rigid item carrier of claim 1, further comprising:

a second handle having a third end and a fourth end, wherein the third end is pivotably attached to the outer surface of the first side panel by a third extension passing through the third side panel, and wherein the fourth end is pivotably attached to the outer surface of the second side panel by a fourth extension passing through the fourth side panel;

a third magnetized element joined to the third extension by a third fastener on the inner surface of the first side panel at the predetermined distance above the first bottom panel; and a fourth magnetized element joined to the fourth extension by a fourth fastener on the inner surface of the second side panel at the predetermined distance above the first bottom panel.

3. The rigid item carrier of claim wherein at least one of the first magnetized element or the second magnetized element is at least one of:

an iron magnet;

a steel magnet;

a cobalt magnet;

a nickel magnet;

a magnetic alloy;

a natural Earth magnet;

a rare-Earth magnet; or a composite magnet.

4. The rigid item carrier of claim 1, wherein each of the first side panel, the second side panel, the first end panel, the second end panel and the first bottom panel is formed from a common material; and wherein the common material is one of:

an acrylonitrile butadiene styrene; a bioplastic; a compostable plastic; an epoxy resin; a metal mesh, a metal sheet, a metal wire, a natural material, a natural plastic; a phenolic resin; a polyester; a polyethylene; a polypropylene; a polyurethane; a polyvinyl chloride; or a recycled plastic.

5. The rigid item carrier of claim 1, wherein at least one of the first side panel, the second side panel, the first end panel, the second end panel or the first bottom panel comprises a plurality of openings extending therethrough, wherein at least two of the openings are arranged in a pattern on the at least one of the first side panel, the second side panel, the first end panel, the second end panel or the first bottom panel, and wherein a shape of at least one of the plurality of openings is a circle or a square.

6. The rigid item carrier of claim 1, wherein at least the first side panel, the second side panel, the first end panel, the second end panel and the first bottom panel form a first tapered volume, and wherein a flexible item carrier is releasably nested within the first tapered volume, wherein the flexible item carrier further comprises:

a third side panel;

a fourth side panel opposite the third side panel;

a third end panel joined to the third side panel and the fourth side panel;

a fourth end panel opposite the third end panel, wherein the fourth end panel is joined to the third side panel and the fourth side panel;

a second bottom panel, wherein each of the third side panel, the fourth side panel, the third end panel and the fourth end panel is joined to the second bottom panel, and wherein at least the third side panel, the fourth side panel, the third end panel, the fourth end panel and the second bottom panel form a second tapered volume corresponding to the first tapered volume;

a first metallic element joined to the third side panel at the predetermined distance above the second bottom panel, wherein the first metallic element is magnetically coupled to the first magnetized element; and a second metallic element joined to the fourth side panel at the predetermined distance above the second bottom panel, wherein the second metallic element is magnetically coupled to the second magnetized element.

7. The rigid item carrier of claim 6, wherein each of the third side panel, the fourth side panel, the third end panel, the fourth end panel and the second bottom panel is formed from at least one of:

a woven fabric comprising one or more plastic fibers;

a woven fabric comprising one or more natural fibers;

a woven fabric comprising one or more paper fibers;

at least one leather;

at least one canvas; or a non-woven fabric comprising at least one of polypropylene or polyethylene.

8. The rigid item carrier of claim 6, wherein the second item carrier further comprises a first handle joined to an upper edge of the third side panel and a second handle joined to an upper edge of the fourth side panel, wherein at least a portion of the first handle is folded between the first side panel and the third side panel, and wherein at least a portion of the second handle is folded between the second side panel and the fourth side panel.

9. A first item carrier comprising:

a first side panel having a first lower edge;

a second side panel having a second lower edge;

a third side panel having a third lower edge;

a fourth side panel having a fourth lower edge;

a first bottom panel having a first edge, a second edge, a third edge and a fourth edge, wherein the first lower edge is joined to the first edge, wherein the second lower edge is joined to the second edge, wherein the third lower edge is joined to the third edge, and wherein the fourth lower edge is joined to the fourth edge;

a first handle having a first end pivotably attached to a first outer surface of the first side panel and a second end pivotably attached to a second outer surface of the second side panel, wherein the first end comprises a first extension passing through a first bore in the first side panel at a first location on the first outer surface, wherein the first extension is joined to a first fastener at a second location on the first inner surface, wherein a first length of the first extension is greater than a first thickness of the first side panel at the first location, and wherein the first location corresponds to the second location; and a second handle having a third end pivotably attached to the first outer surface of the first side panel and a fourth end pivotably attached to the second outer surface of the second side panel; and a first magnetized element attached to a first inner surface of the first side panel at a first distance above the first lower edge, wherein the first magnetized element is a magnetized disk joined to the first extension by the first fastener at the second location.

10. The first item carrier of claim 9, wherein the first magnetized element is at least one of:

an iron magnet;

a steel magnet;

a cobalt magnet;

a nickel magnet;

a magnetic alloy;

a natural Earth magnet;

a rare-Earth magnet; or a composite magnet.

11. The first item carrier of claim 9, wherein each of the first side panel, the second side panel, the third side panel, the fourth side panel and the first bottom panel is formed from a common material; and wherein the common material is one of:

an acrylonitrile butadiene styrene; a bioplastic; a compostable plastic; an epoxy resin; a metal mesh, a metal sheet, a metal wire, a natural material, a natural plastic; a phenolic resin; a polyester; a polyethylene; a polypropylene; a polyurethane; a polyvinyl chloride; or a recycled plastic.

12. The first item carrier of claim 9, wherein at least one of the first side panel, the second side panel, the third side panel or the fourth side panel comprises a plurality of openings extending therethrough, and wherein at least two of the openings are arranged in a pattern on the at least one of the first side panel, the second side panel, the third side panel or the fourth side panel.

13. The first item carrier of claim 9, wherein the at least one of the first side panel, the second side panel, the third side panel or the fourth side panel comprises a plurality of openings provided in a pattern, and wherein a shape of at least one of the plurality of openings is a circle or a square.

14. The first item carrier of claim 9, wherein at least the first side panel, the second side panel, the third side panel, the fourth side panel, and the first bottom panel form a first tapered volume, and wherein the first item carrier further comprises a second item carrier releasably nested within the first tapered volume, wherein the second item carrier further comprises:

a fifth side panel having a fifth lower edge;

a sixth side panel having a sixth lower edge;

a seventh side panel having a seventh lower edge;

an eighth side panel having an eighth lower edge;

a second bottom panel having a fifth edge, a sixth edge, a seventh edge and an eighth edge, wherein the fifth lower edge is joined to the fifth edge, wherein the sixth lower edge is joined to the sixth edge, wherein the seventh lower edge is joined to the seventh edge, wherein the eighth lower edge is joined to the eighth edge, and wherein at least the fifth side panel, the sixth side panel, the seventh side panel, the eighth side panel, and the second bottom panel form a second tapered volume; and a first metallic element attached to the fifth side panel at the first distance above the fifth lower edge, and wherein the first metallic element is magnetically coupled to the first magnetized element.

15. The first item carrier of claim 14, wherein a shape of the first tapered volume of the first item carrier and a shape of the second tapered volume of the second item carrier are substantially identical, and wherein a size of the second tapered volume of the second item carrier is not greater than a size of the first tapered volume of the first item carrier.

16. The first item carrier of claim 14, wherein the second side panel comprises a second inner surface, wherein the third side panel comprises a third inner surface, wherein the fourth side panel comprises a fourth inner surface and wherein the first bottom panel comprises a first inner surface, wherein the fifth side panel comprises a third outer surface, wherein the sixth side panel comprises a fourth outer surface, wherein the seventh side panel comprises a fifth outer surface, wherein the eighth side panel comprises a sixth outer surface, and wherein the second bottom panel comprises a seventh outer surface, wherein the first inner surface is adjacent to the third outer surface, wherein the second inner surface is adjacent to the fourth outer surface, wherein the third inner surface is adjacent to the fifth outer surface, wherein the fourth inner surface is adjacent to the sixth outer surface, and wherein the fifth inner surface is adjacent to the seventh outer surface.

17. The first item carrier of claim 14, wherein each of the fifth side panel, the sixth side panel, the seventh side panel, the eighth side panel and the second bottom panel of the second item carrier is formed from at least one of:

a woven fabric comprising one or more plastic fibers;

a woven fabric comprising one or more natural fibers;

a woven fabric comprising one or more paper fibers;

at least one leather;

at least one canvas; or a non-woven fabric comprising at least one of polypropylene or polyethylene.

18. The first item carrier of claim 14, further comprising a second magnetized element attached to a second inner surface of the second side panel at the first distance above the second lower edge, wherein the second item carrier further comprises a second metallic element attached to a second inner surface of the sixth side panel at the first distance above the sixth lower edge; and wherein the second metallic element is magnetically coupled to the second magnetized element.

19. The first item carrier of claim 18, further comprising:

a third magnetized element attached to the first inner surface of the first side panel at the first distance above the first lower edge, wherein the third magnetized element is provided at a second distance from the first magnetized element; and a fourth magnetized element attached to the second inner surface of the second side panel at the first distance above the second lower edge, wherein the third magnetized element is provided at the second distance from the second magnetized element, wherein the second item carrier further comprises:

a third metallic element attached to the first inner surface of the fifth side panel at the first distance above the fifth lower edge, wherein the third metallic element is provided at the second distance from the first metallic element; and a fourth metallic element attached to the second inner surface of the sixth side panel at the first distance above the sixth lower edge, wherein the fourth metallic element is provided at the second distance from the second metallic element, wherein the third metallic element is magnetically coupled to the third magnetized element, and wherein the fourth metallic element is magnetically coupled to the fourth magnetized element.

20. A first item carrier comprising:

a first side panel having a first lower edge;

a second side panel having a second lower edge;

a third side panel having a third lower edge;

a fourth side panel having a fourth lower edge;

a first bottom panel having a first edge, a second edge, a third edge and a fourth edge, wherein the first lower edge is joined to the first edge, wherein the second lower edge is joined to the second edge, wherein the third lower edge is joined to the third edge, wherein the fourth lower edge is joined to the fourth edge, and wherein at least the first side panel, the second side panel, the third side panel, the fourth side panel, and the first bottom panel form a first tapered volume;

a first handle having a first end pivotably attached to a first outer surface of the first side panel and a second end pivotably attached to a second outer surface of the second side panel; and a second handle having a third end pivotably attached to the first outer surface of the first side panel and a fourth end pivotably attached to the second outer surface of the second side panel;

a first magnetized element attached to a first inner surface of the first side panel at a first distance above the first lower edge;

a second item carrier releasably nested within the first tapered volume, wherein the second item carrier further comprises:

a fifth side panel having a fifth lower edge;

a sixth side panel having a sixth lower edge;

a seventh side panel having a seventh lower edge;

an eighth side panel having an eighth lower edge;

a second bottom panel having a fifth edge, a sixth edge, a seventh edge and an eighth edge, wherein the fifth lower edge is joined to the fifth edge, wherein the sixth lower edge is joined to the sixth edge, wherein the seventh lower edge is joined to the seventh edge, wherein the eighth lower edge is joined to the eighth edge, and wherein at least the fifth side panel, the sixth side panel, the seventh side panel, the eighth side panel, and the second bottom panel form a second tapered volume, wherein each of the fifth side panel, the sixth side panel, the seventh side panel, the eighth side panel and the second bottom panel of the second item carrier is formed from at least one of:

a woven fabric comprising one or more plastic fibers;

a woven fabric comprising one or more natural fibers;

a woven fabric comprising one or more paper fibers;

at least one leather;

at least one canvas; or a non-woven fabric comprising at least one of polypropylene or polyethylene;

a first handle panel having a first handle joined to a first upper edge of the fifth side panel;

a second handle panel having a second handle joined to a second upper edge of the sixth side panel, wherein at least a portion of the first handle panel is folded between the first side panel and the fifth side panel, and wherein at least a portion of the second handle panel is folded between the second side panel and the sixth side panel; and a first metallic element attached to a first inner surface of the fifth side panel at the first distance above the fifth lower edge, and wherein the first metallic element is magnetically coupled to the first magnetized element.

* * * * *